United States Patent [19]

Matsumoto et al.

[11] Patent Number: 4,657,206

[45] Date of Patent: Apr. 14, 1987

[54] DOOR INSTALLATION AND A LOCKING DEVICE USED THEREIN

[75] Inventors: Tadashi Matsumoto; Katsuya Fukakura, both of Osaka, Japan

[73] Assignee: National House Industrial Co., Ltd., Osaka, Japan

[21] Appl. No.: 499,445

[22] Filed: May 31, 1983

[30] Foreign Application Priority Data

| | | | |
|---|---|---|---|
| May 31, 1982 | [JP] | Japan | 57-93753[U] |
| Jul. 30, 1982 | [JP] | Japan | 57-116379[U |
| Aug. 31, 1982 | [JP] | Japan | 57-132606[U] |
| Aug. 31, 1982 | [JP] | Japan | 57-132607[U] |
| Sep. 30, 1982 | [JP] | Japan | 57-150224[U] |
| Dec. 29, 1982 | [JP] | Japan | 57-196617[U] |

[51] Int. Cl.[4] ..... E05C 1/16

[52] U.S. Cl. ..... 292/173; 292/150; 292/DIG. 56

[58] Field of Search ..... 292/341.12, DIG. 56, 292/150, 153; 70/143

[56] References Cited

U.S. PATENT DOCUMENTS

| | | | |
|---|---|---|---|
| 1,194,636 | 8/1916 | Joy | 292/DIG. 56 |
| 2,786,701 | 3/1957 | Povlich | 292/341.16 X |
| 2,860,905 | 11/1958 | Wiese | 292/341.12 |
| 2,869,913 | 1/1959 | Schlage | 292/341.12 |
| 3,912,309 | 10/1975 | Fiacher et al. | 70/143 X |
| 4,255,953 | 3/1981 | Dietrich et al. | 70/143 X |

*Primary Examiner*—Richard E. Moore

*Attorney, Agent, or Firm*—Birch, Stewart, Kolasch & Birch

[57] ABSTRACT

A door installation and a locking device used therein. The door installation consisting of a door provided with the body of a lock a of the locking device, and frame members fitted with a receiving plate thereof. The body of lock has a bolt built-in. This bolt is held optionally in the half-projecting position between the wholly projecting position and the door-opening position by handling operating units. The bolt in turn puts a controlling means in motion, whereby it is possible to make an electric circuit operate automatically ON or OFF, which electric circuit is arranged to interpose in itself electric appliances, for example, such as lighting apparatuses being disposed indoors or outdoors, therefore giving practical effect to the simplification of operating the lighting on-and-off and to the power saving, and further contributing to the safety problem through preventing overheating and leakage caused by the possible neglect of not turning lighting off.

14 Claims, 93 Drawing Figures

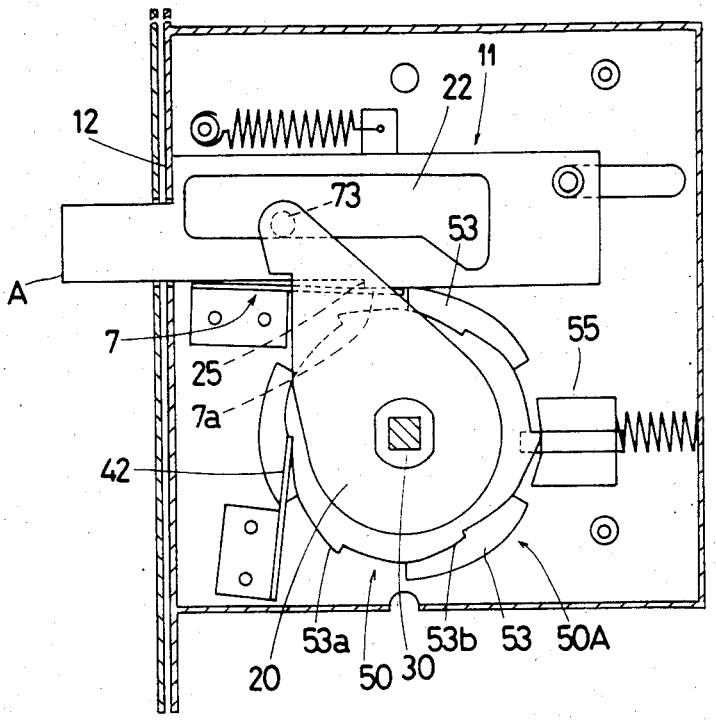
FIG. 7
FIG. 8
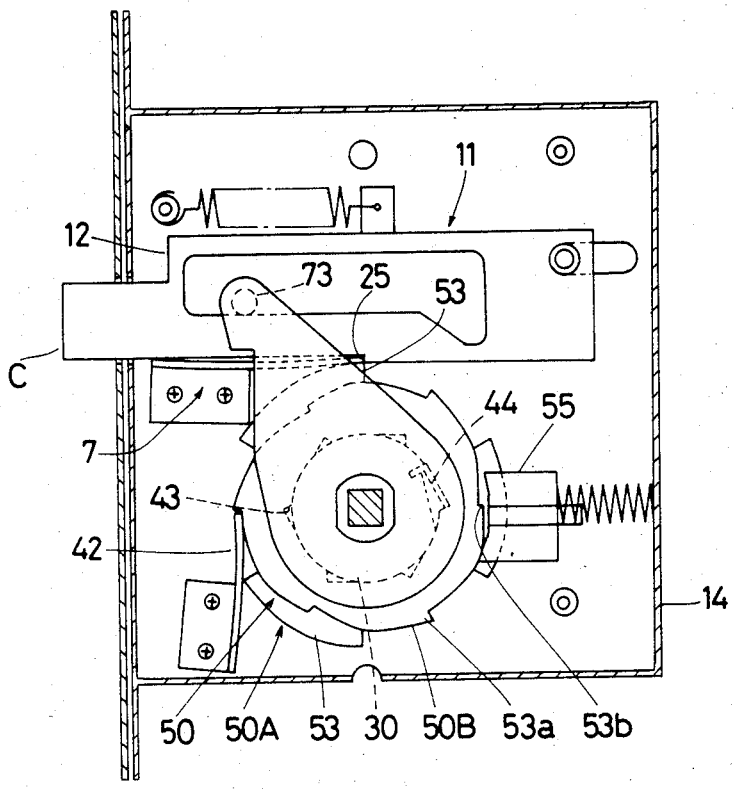

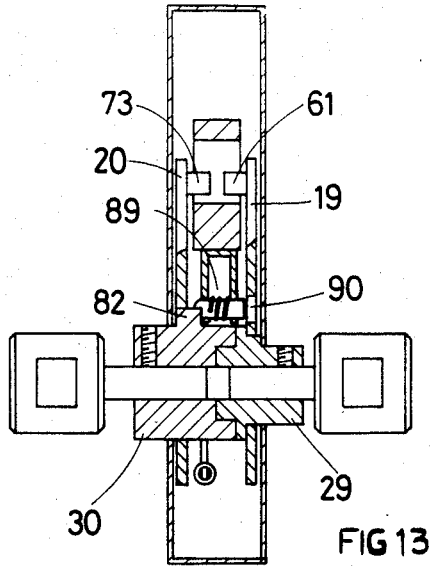
FIG 13
FIG.14
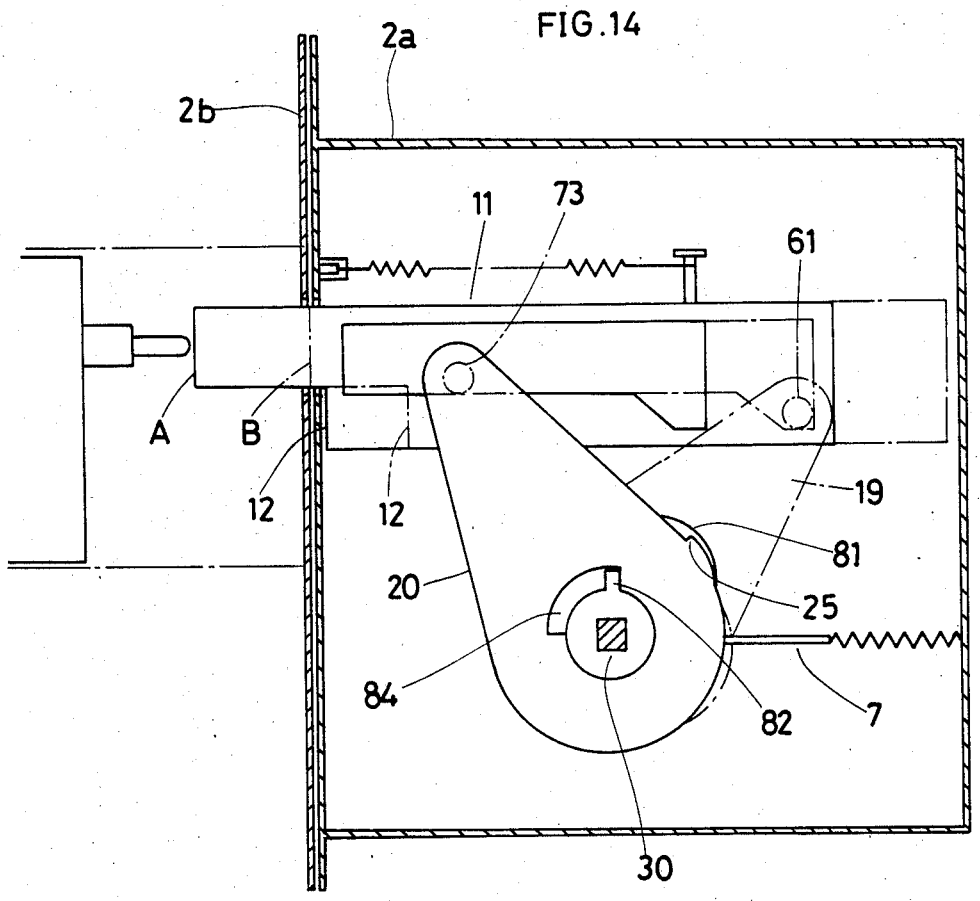

FIG. 18
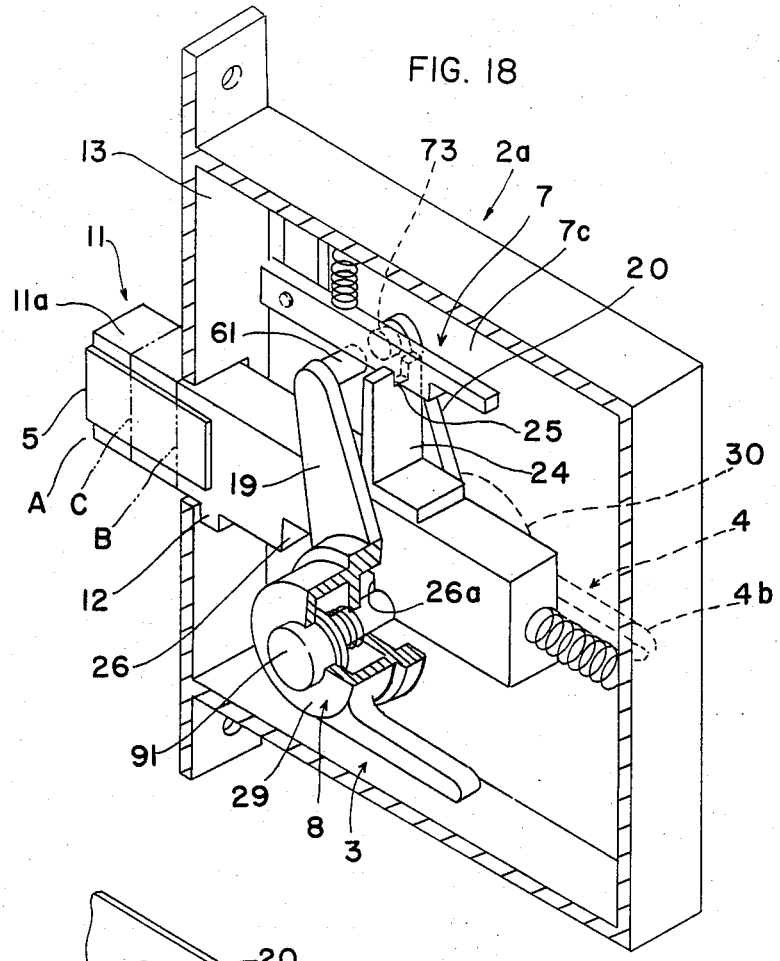
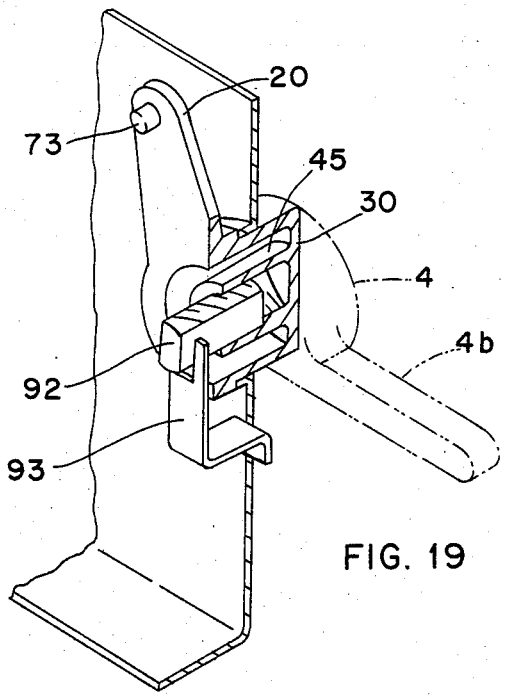
FIG. 19

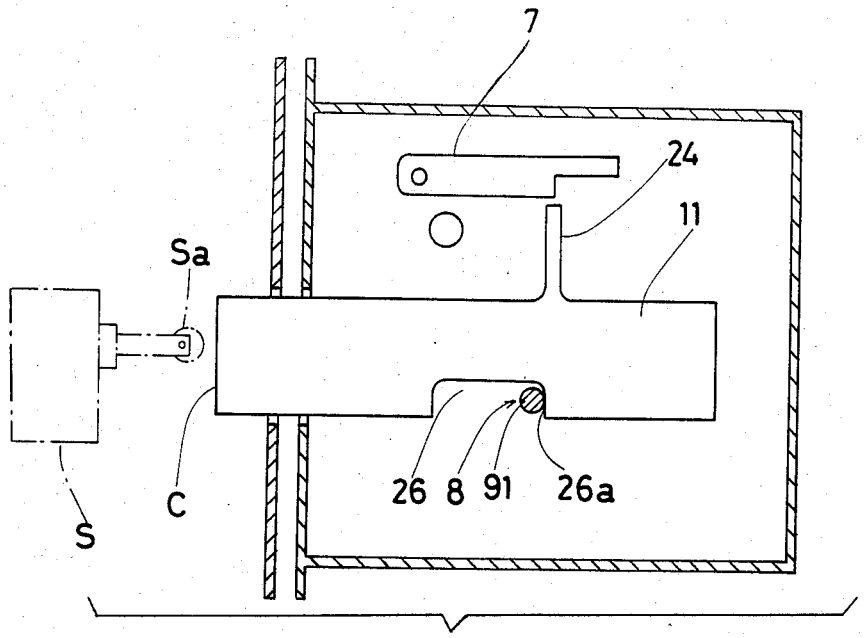
FIG. 22
FIG.23(b)
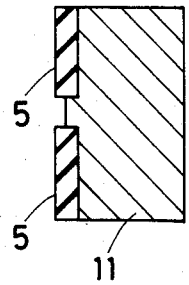
FIG. 23(a)
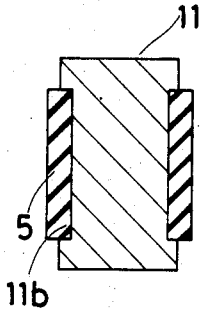
FIG. 23(c)
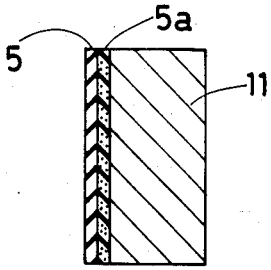

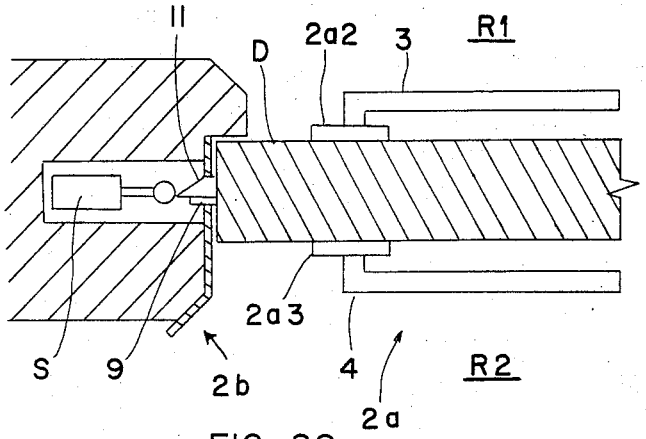
FIG. 28
FIG. 29
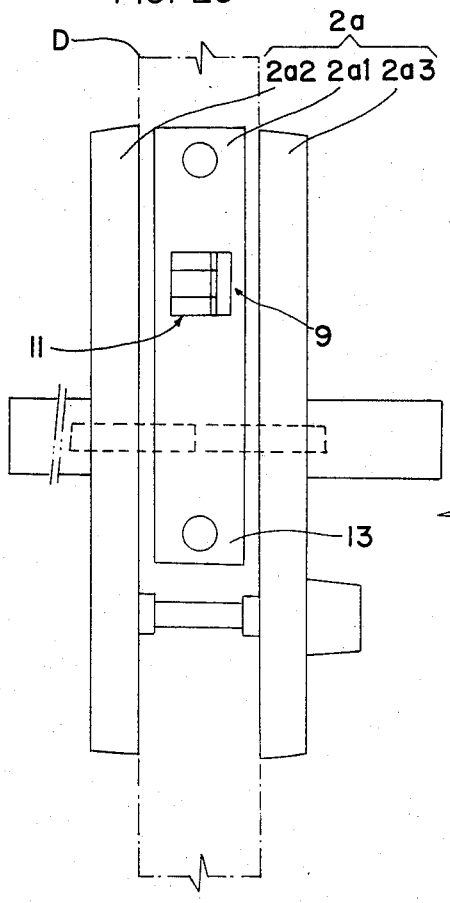
FIG. 30
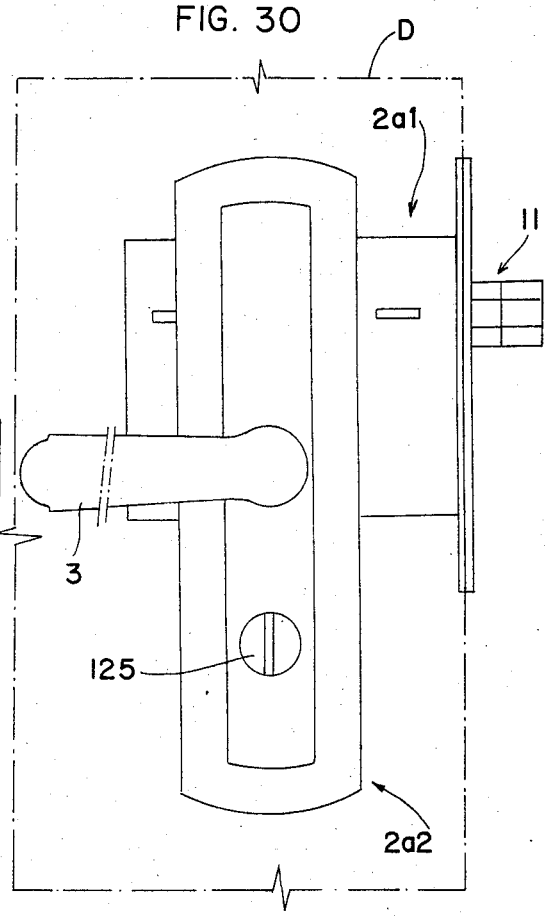

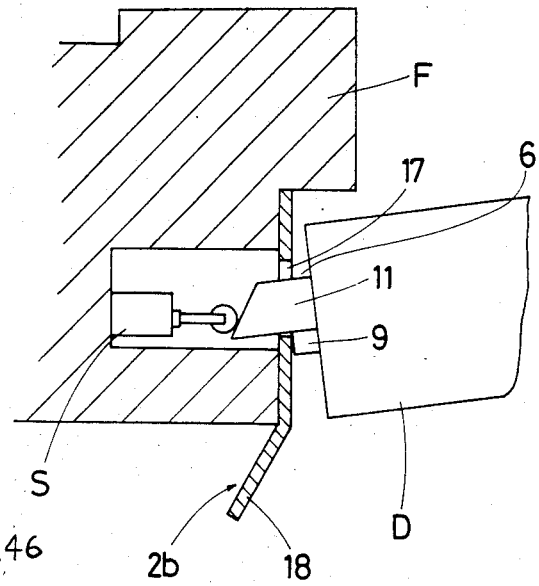
FIG.46
FIG.47
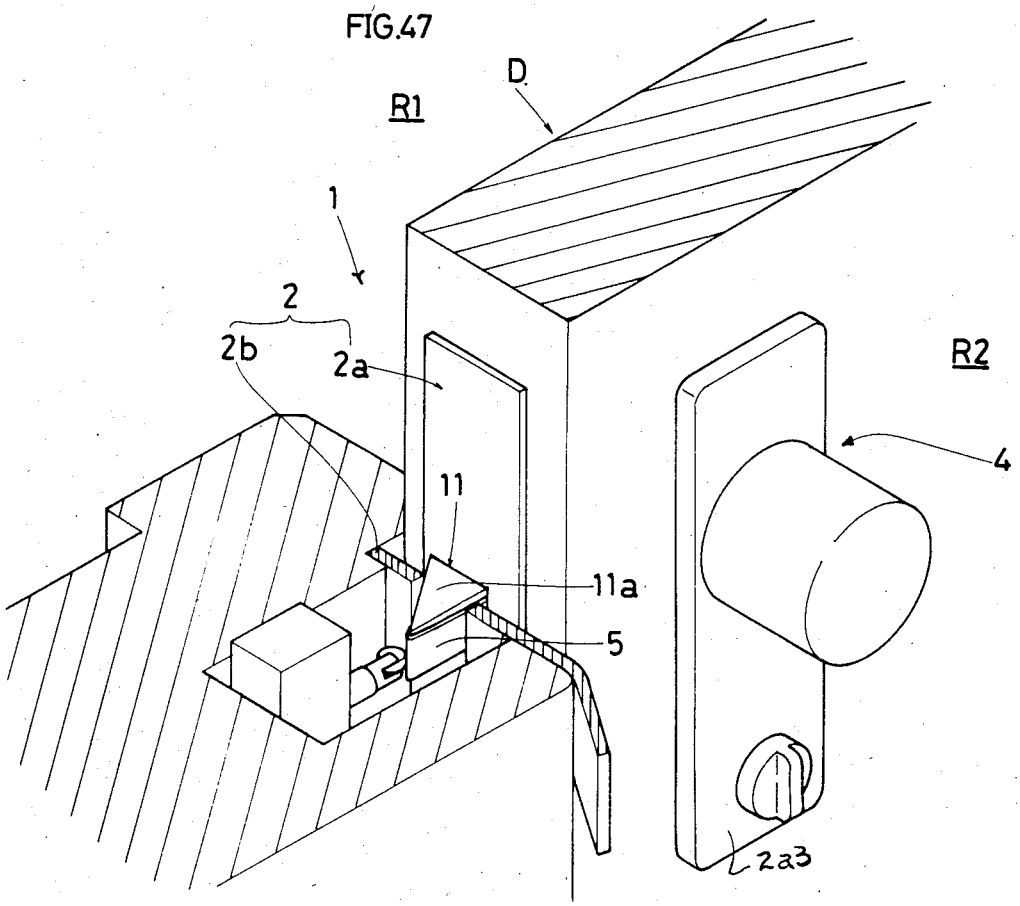

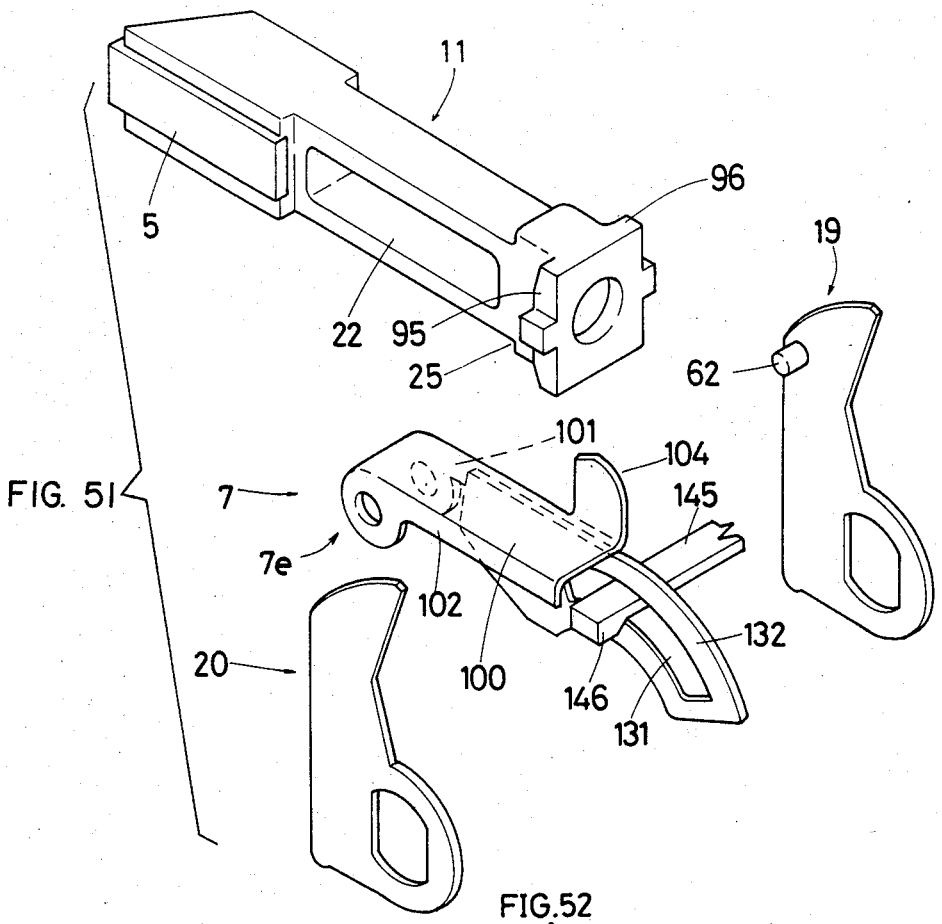
FIG.52
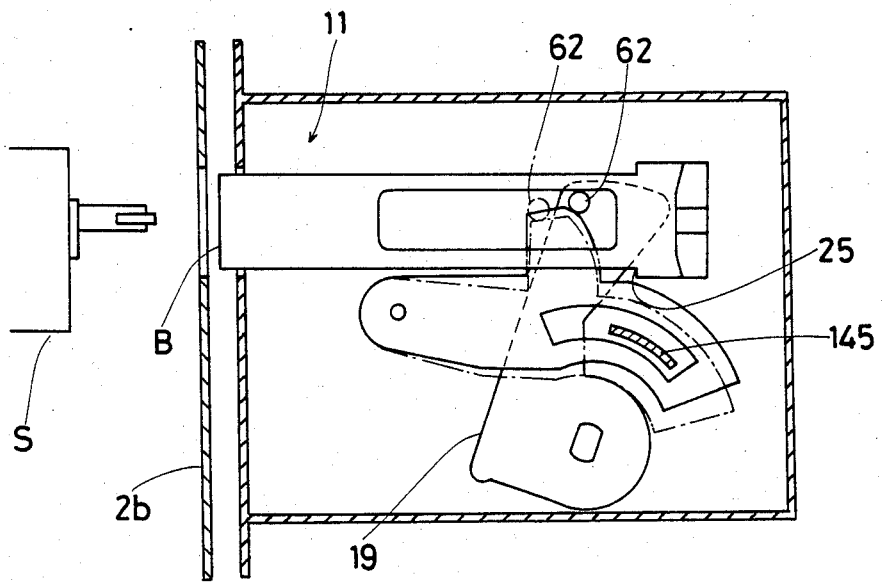

FIG. 55(b)
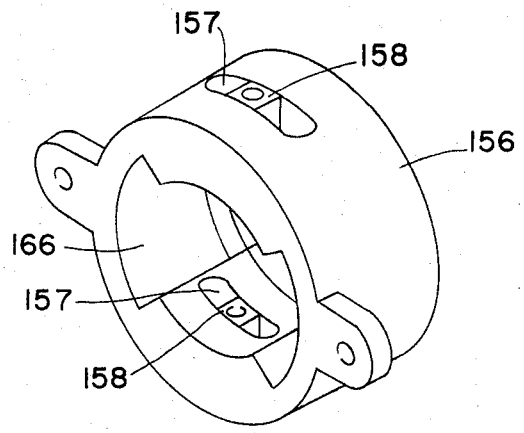
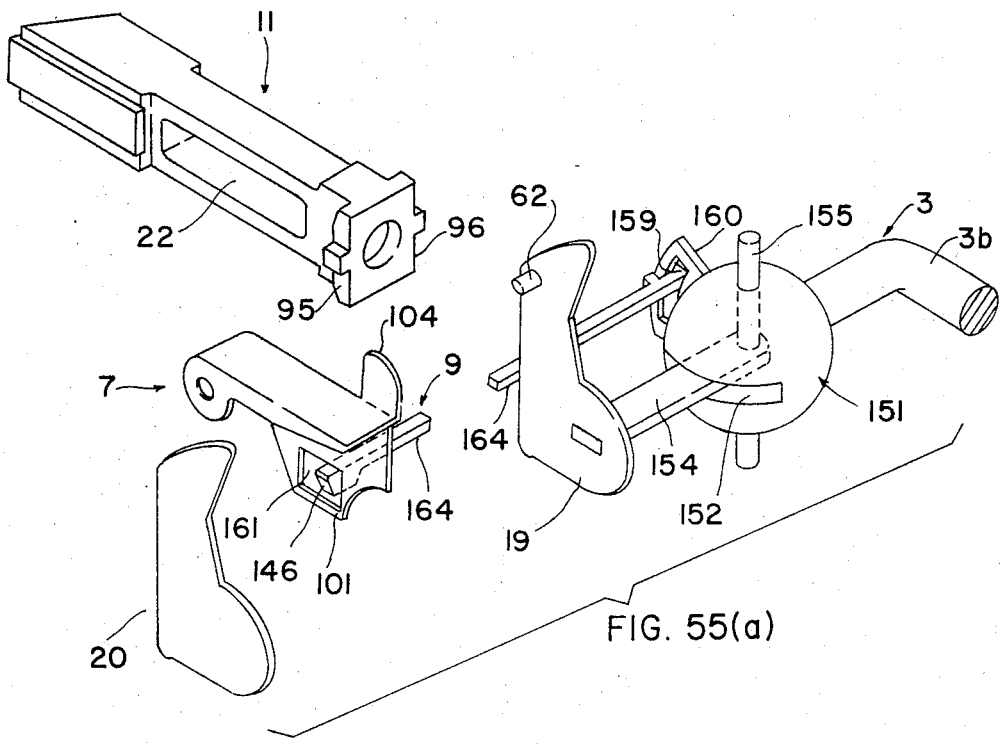
FIG. 55(a)

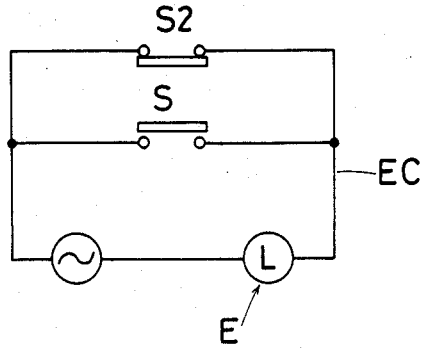
FIG. 58
FIG. 59
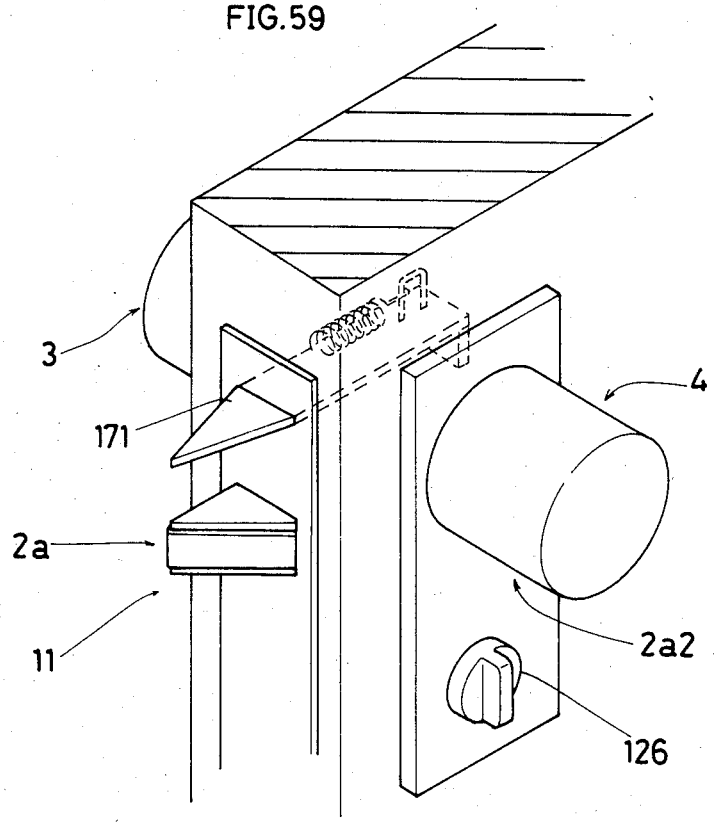

FIG. 62(a)
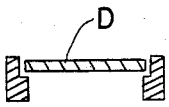
FIG. 62(c)
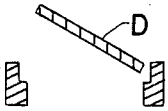
FIG. 62(e)
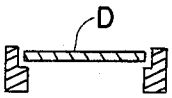
FIG. 62(b)
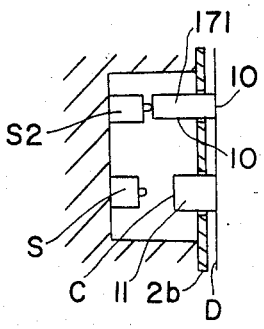
FIG. 62(d)
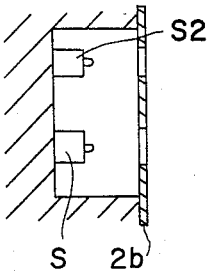
FIG. 62(f)
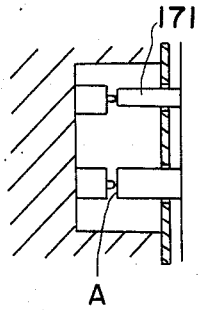
FIG. 62(g)
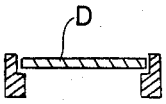
FIG. 62(i)
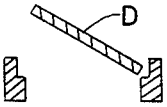
FIG. 62(k)
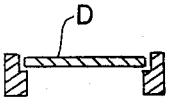
FIG. 62(h)
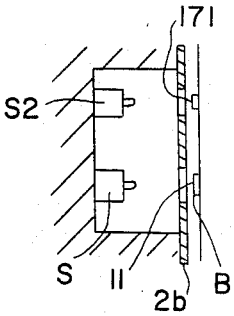
FIG. 62(j)
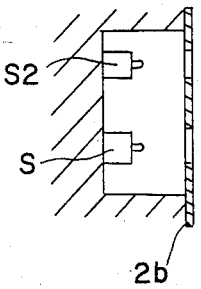
FIG. 62(ℓ)
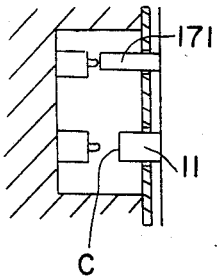

R1

13
3
174
173
11a
19
175
11
184
7
20
178
158
96
156
155
176
95
183
14
151
187
186
180
181
185

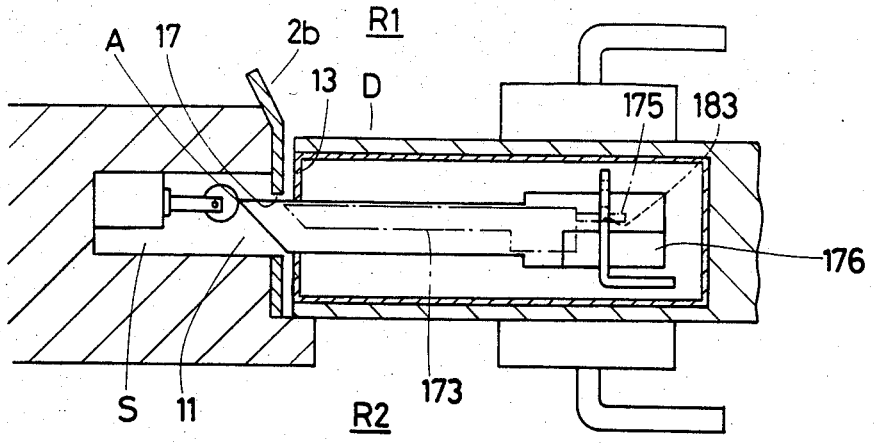
FIG. 64
FIG. 65
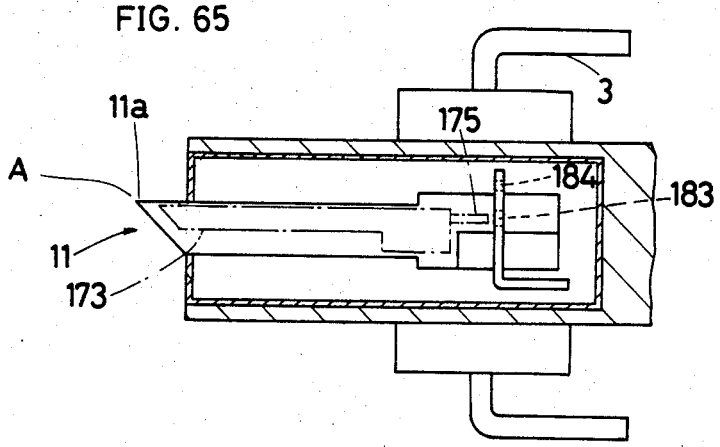
FIG. 66
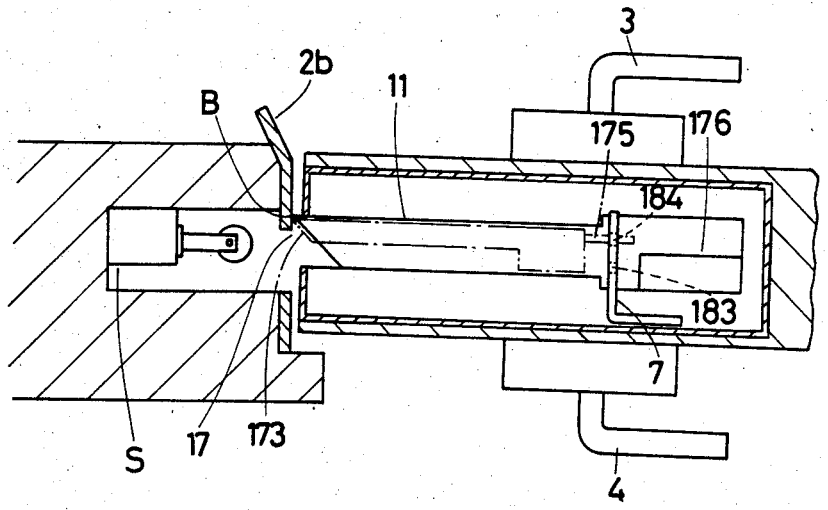

EF
F3
E
L2
W1
P
L1
F1
G
D
CA
S3
1
2b
S
3
CS
2a
4
F2
F4

DOOR INSTALLATION AND A LOCKING DEVICE USED THEREIN

BACKGROUND OF THE INVENTION

This invention relates to a door installation and a locking device used therein which is so devised as to make electric appliances such as an electric lamp and others automatically switch on and off by opening and shutting the door. More particularly, to a door installation and a locking device used therein, wherein the body of the lock being built in the door is provided with a bolt which is held optionally in the half-projecting position between the wholly projecting position and the door-opening position by handling operating units. The bolt or lock lever in turn puts a controlling means in motion, whereby it is possible to make an electric circuit operate automatically ON or OFF, which electric circuit is arranged to interpose in itself electric appliances, for example, such as lighting apparatuses being disposed indoors or outdoors, therefore giving practical effect to the simplification of operating the switching on-and-off and to a power saving, and further contributing to a safety problem through preventing the overheat and leak caused by the possible neglect of not turning lighting off.

Hitherto, the lighting on-and-off of illuminaters or heaters at the time of going in and out through the door is usually done by switching-on before the entrance or by switching-off after the exit. In either case, in order to put on and out lights, we must make some other switching operating separately from the operation of opening and shutting of the door. This costs not only labor but also it is liable to bring about the waste of power attributable to the neglect of the switching-off, and further it is attended with the danger of overheat and leak in case of forgetting to put out lights. In particular, a certain kind of device which is so designed as to be put up after entering the room has such a defect that we are compelled to enter the ill-lit room at the moment of opening the door, therefore being required to labor and fumble in the darkness for the switch and operate it.

As an aid to resolve such a difficulty as mentioned above, some devices were contrived, for example, such as the one wherein the door is as a rule energized to the opening side and the lighting-on is done by making the electric circuit operate ON automatically at the time of the door being shut, the other wherein the lighting-on is automatically done in concurrence with the opening of the door without the inconvenient necessity of the switching operation in the ill-lit room, and so on. However, the former which is kept open as a rule makes a home poor in outward appearance, while the latter which put up the light at the opening time is liable to be left in a state of the door being opened as it is, when the state of being lighted-up is continued, being attended with the waste and danger of power as well as the neglect of switching-off, as mentioned above.

On the other hand, there are known heretofore various kinds of locks such as what is called a rim rock, a monolock, and the like which all are provided in the interior of their own cases with bolts for use in substantially or temporarily fastening the door. All of these bolts go to and fro between the door opening position and the wholly projecting position, and it is only at their wholly projecting position that they can securely hold the door.

Conventional locking devices of such a type that can hold the door only in the wholly projecting position are not capable of discriminating by themselves the state during staying in the room or after retiring from the room according to the then positions of their bolts, wherefore they can not form such door installations as described above which make the automatic motion of lighting on and off. Other than above, there is known also such a device that is equipped with a switch for the coming-out and going-down of the dead bolt of the rim-lock and also finding out the release of the lock, and a switch for detecting the advance or retract of the latch bolt of the cylinder lock and recognizing the opening and shutting of the door, whereby the release of the lock and the opening and shutting of the door are made to be remotely indicated. However such a type is complicated in structure, more than that, can not detect the motion of the person at the time of entering and retiring from the room, and has a mere function to indicate the release of the lock and the opening and closing of the door. Therefore, it is nothing but one that is not able to perform a series of motion such as the lighting-on of the room at the time of entering the room, the lighting-off after going out of the room consecutively, and so on.

Incidentally, there is also such a type of device that lights up during staying in the room by the use of a detector which finds out the incoming persons through the radiation of infrared rays or laser. However such kind of detector has various defects such that it is not only expensive but also it is liable to produce error function, while on the other hand it needs the conduction of electricity, therefrom being accompanied with the danger of waste of electricity.

Hereupon, our inventors have become aware of a number of conversial points and requests in the course of bringing the present invention in completion as follow:

(a) This invention is premised on an assumption that the handling of the operating unit should be executed with certainty. To this end, it is sometimes desirable to provide such a check piece that can project concurrently with the opening of the door, check the door from shutting, and further go back by the handling of the operating unit on the inner side of the door of the room where one has already stepped in.

(b) Such a check piece impinges against the receiving plate when the door is shut, so that it is liable to give an unnatural impact on the check piece and the receiving plate, which leads often to a risk of the failure of both.

(c) There is a case where it takes some increasing labor in the operation of the operating unit at the time of making the above mentioned check piece go backward. If the case is so, it is sometimes desirable to simplify such labor as much as possible and to be able to operate in a same manner as in the handling of an ordinary "temporarily fastening lock".

(d) The door installation to automate the lighting on-and-off of electric appliances while mechanically interlocking with the operation of opening and shutting the door requires the payment of increasing labor and effort in order to incorporate switches, electric appliances and others into the door and/or the door frame. Accordingly, supposing all of these operations are executed on the spot, they are apt to become inferior in the efficiency of execution and unstable in quality.

(e) In the case of the door installation used at a restroom, e.g., it suffices to take only a single person into consideration, but it is necessary for it to work well also in the place were a plurality of persons go at random in and out.

OBJECT OF THE INVENTION

It is therefore an object of the present invention to provide a door installation which is able to light automatically on and off electric appliances such as a lighting apparatus, electric fan, and others in accompany with opening and shutting the door, and which makes the switching operation convenient.

Another object of the present invention is to provide a door installation which has a block lever being to be held in the half-projecting position between the wholly projecting position and the door opening position, and which makes controlling means work by means of the above-mentioned bolt.

A further object of the present invention is to provide a door installation wherein the room is lit by electricity in concurrence with opening and shutting the door and this lighting is kept certainly even when the door is shut after one enters the room.

Still a further object of the present invention is to provide a door installation provided with a check piece which projects at the same time the door is opened, and which secures the door-shutting with certitude thereby being able to present the incompleteness of the operation.

Another object of the present invention is provide a door installation which has the ability to mitigate the impact produced by the impingement of the above-mentioned check piece and the receiving plate by the provision of a buffering member.

Yet another object of the present invention is to provide which can simplify the handling of the operating unit, to be able to open and shut the door by the almost same operation as in the case of an ordinary temporarily fastening lock.

A still further object of the present invention is to provide a door installation which can light automatically on and out by opening and shutting the door, and which is simplified in assembling.

An additional object of the present invention is to provide a door installation which is easy and smooth to handle even when a plurality of persons go in and out at one time or at random.

Still a further object of the present invention is to provide a door installation which can perform the lighting on-and-off as properly as possible even when the process of opening and shutting the door is different from the ordinary ones.

Another and last object of the present invention is to provide a locking device which is able to be applied to such a door installation as mentioned above.

Other features and advantages of the invention will be apparent from the following description taken in connection with the accompanying drawing.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 is a front view showing another example of the present invention;

FIG. 8 is a front view showing a state where the cam has rotated;

FIG. 11(*b*) is a cross-sectional view thereof;

FIG. 11(*c*) is a front view illustrating the bossed part;

FIG. 13 is a cross-sectional view in the central part of the same;

FIGS. 14, 15, and 16 are diagrams showing the working of the same in FIGS. 12 and 13;

FIG. 18 is a perspective view broken-away in part illustrating the body of lock of the same;

FIG. 19 is a perspective view showing the second operating unit thereof;

FIGS. 20, 21, and 22 are diagrams showing the working of the same in FIG. 19;

FIGS. 23(*a*), (*b*), and (*c*) are cross-sectional views of buffering members being attached to the bolt;

FIG. 28 is a cross-sectional view in rough of the same;

FIG. 29 is a front view illustrating the body of lock being used in the example in FIG. 27;

FIG. 30 is a left-side view thereof;

FIG. 46 is a cross-sectional view showing the working;

FIG. 47 is a perspective view showing still a further example of the present invention;

FIG. 51 is an exploded view in perspective showing the principal part;

FIGS. 52 and 53 are diagrams showing the working:

FIG. 55(*a*) is an exploded view in perspective illustrating the second operating unit being used in the example in FIG. 47;

FIG. 55(*b*) is a perspective view illustrating the exterior part;

FIG. 58 is an electric circuit diagram thereof;

FIG. 59 is a perspective view showing a further example of the present invention;

FIGS. 62(*a*) to (*b*) are diagrams showing the working thereof;

FIGS. 64 to 67 are perspective views in rough showing the working thereof;

DETAILED DESCRIPTION

Figure 1:
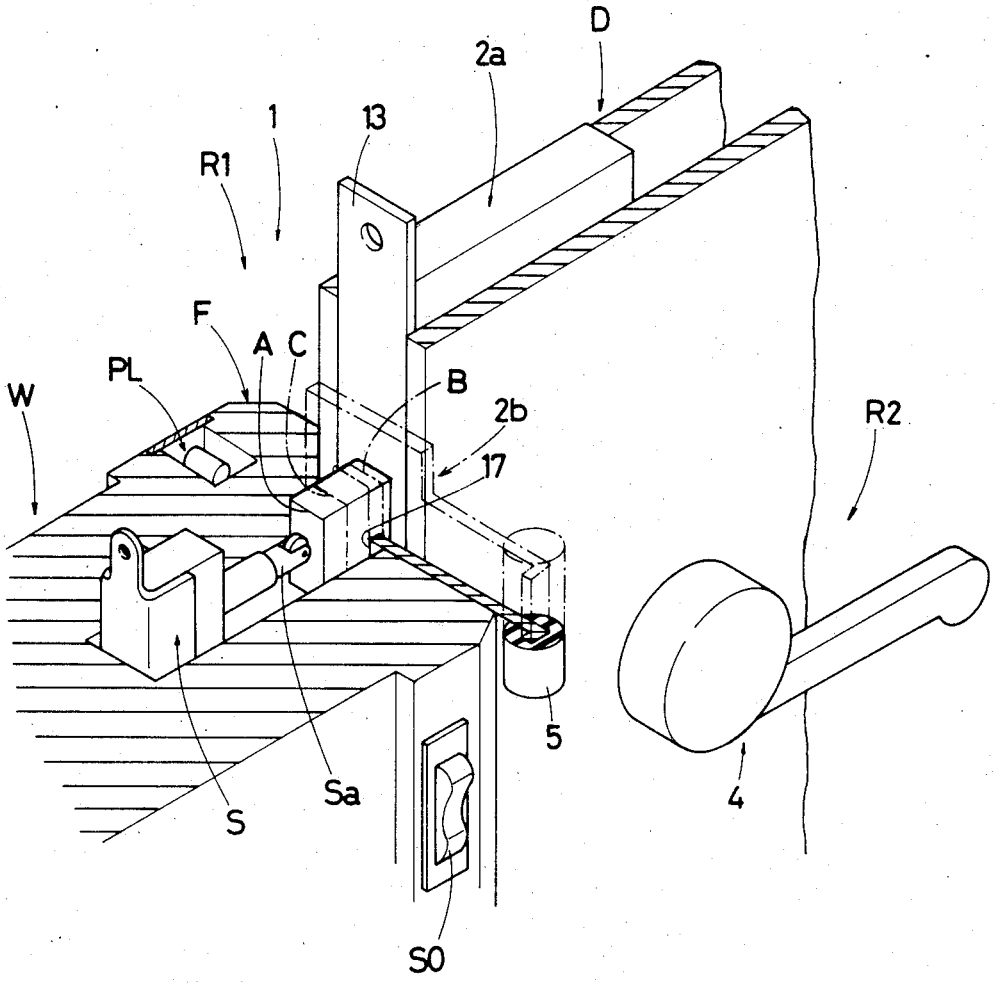
FIG. 1 is a perspective view showing an example of the present invention.

We will now describe examples of the present invention with reference to the drawing in order.

FIGS. 1 to 6 all show a basic example of the invention, wherein a door installation 1 is provided with a locking device 2 consisting of a body of lock 2*a* being attahced to the door D and a receiving plate 2*b*. The door D opens and shuts the opening part being cut open in a wall W with which a building is partitioned into the interior and the exterior or the interior of the building is partitioned into two spaces $R_1$ $R_2$. Thus the door D is formed as a single swing door, for example, opening from the space $R_1$ to the space $R_2$. Incidentally, in this example, let us suppose that the space $R_1$ is, for example, a corridor, and the space $R_2$ is a room which is as a rule lighted out, such as a toilet, a bath room, a back room, and such like, for convenience' sake.

Figure 2:
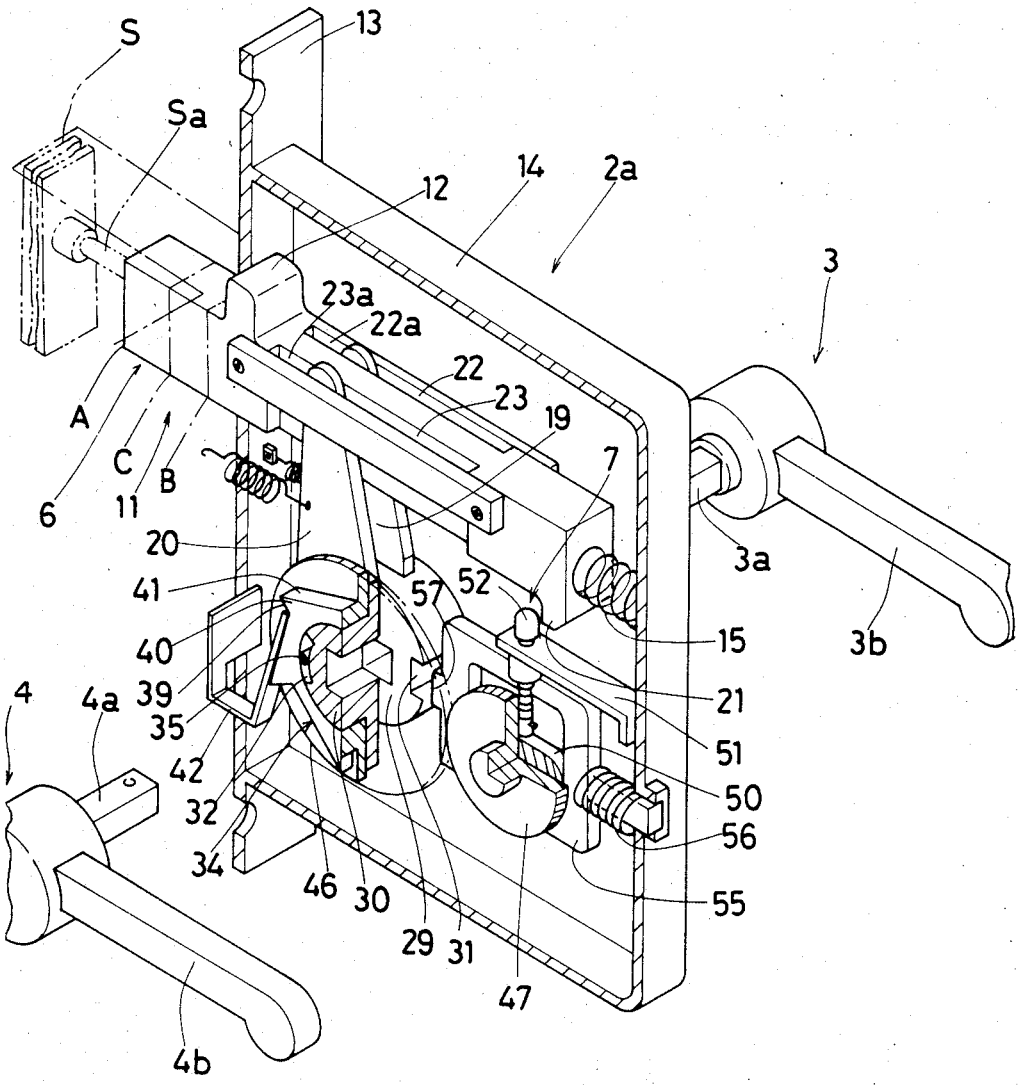
FIG. 2 is a perspective view broken-away in part showing the body of lock thereof.

The body of lock 2*a* is provided with first and second operating units 3, 4 projecting on both sides of the door D. The first and second operating units 3, 4 are formed handle-shapedly and installed rotatably. Within the body of lock 2*a* as illustrated in FIG. 2, is housed a bolt 11. This bolt 11, which is energized forward by a spring 15 in a case 14, is so arranged as to be able to move back and forth between the wholly projecting position A where a striking piece 12 formed being retracted from the head part of the bolt 11 slightly to the back impinges against a front 13 and the door-opening position B where the bolt 11 can release the door D by pulling-in the bolt 11 to the front side so much so that it merges in the front 13. And yet, the bolt 11 can be engaged also at a half-projecting position C between the above door-opening position B and the wholly projecting position A. Besides, in this example, the body of lock 2*a* can engage the bolt or lock lever 11 on the above-mentioned half-projecting position C by handling, for example, the second operating unit 4.

The receiving plate 2*b* in which the bolt 11 engages fittingly, is a nearby T-shaped plate body, on whose basal part an engaging hole 17 is excavated and to whose side part a buffering member 5 is attahced. This buffering member 5 is mounted on a vertical frame F in a position of the opening side of the door D, whereby the receiving plate 2*b* buffers the bolt 11 when the projected latter impinges against the buffering member 5. The engaging hole 17 is communicated with a hole part which is provided at the vertical frame F concavely. Within this hole part is received a controlling means S made up of, for example, a micro-switch in such a manner as turning its working head Sa toward the outside. On the outdoor side of the vertical frame F is mounted a pilot lamp PL, on the indoor side a switch SO. The controlling means S and the switch SO are parallel-connected to an electric circuit EC which interconnects such electric appliances E as the pilot lamp PL, a lighting apparatus L, a fan, a heater H, and the like, by the working of which, a relay R is actuated and a contact R is closed, the electric circuit EC is put into the ON position. By the way, the electric circuit EC also is able to be driven directly by the controlling means S without using the relay R. This controlling means S is, for example, a micro-switch, which is fitted in an engaging hole 17 which is prepared concavely in the vertical frame F and into which the bolt 11 can be inserted and engaged, in such a manner that it turns its working head Sa toward the bolt 11. Concurrently with the working head Sa being pressed by the bolt 11 in its wholly projecting position A, the microswitch which is set in the state of the normally closed contact, can put the electric circuit EC in the OFF condition and with the retreat of the bolt 11 which is in fhe door-opening position B and also in the half-projecting position C, the electric circuit EC is maintained in the ON condition. The bolt 11 is provided under its rear end with a protrusion 21 for engaging which is formed slant in the under backface. The bolt 11 has on both side two groove parts which extend from the rear part of a striking piece 12 to the rear part and which constitute guide grooves 22, 23 by covering the above grooves with the aid of keep plates. Into these guide grooves 22, 23 are inserted the top end parts of the first and second lever 19, 20 which are installed on the supporting shafts 3*a*, 4*a* of the operating units 3, 4, respectively. The first lever 19 and the second lever 20 each are provided at their basal parts with the bossed parts 29, 30 through which the square holes are concentrically bored, respectively. On the bossed part 30 is made concavely an engaging recess 31 in the position which turns to the rear at the time of the standard state of the first lever 19 inclining forward. On the bossed part 30 is formed a clutch groove 32 which increases the depth in the direction of the rearward inclination of the second lever 20. In the clutch groove 32 is received a clutch pin 35 using, for example, a cylinder pin which also impinges upon the interior of a ratchet wheel 34 fitting in the bossed part 30. This ratchet wheel 34 forms in the 60° pitch a ratchet part 40 having an engaging face 39 extending on the radial direction and on the inclining side of the second lever 20. The back of the above ratchet part 40 is formed with a plane surface 41 extending from the pointed end of the ratchet part 40 to the root part. Against this plane surface 41 impinges a nearly U-shaped spring piece 42 which is attached to the lower part of the front 13 of the case 14 and which prevents the ratchet part 40 from backing at every 60° by being engaged by the engaging face 39, and, in case of rotating more than 60°, for example, 75°, presses down the ratchet part 40 to make it back to the rotating position of 60° where the plane face 41 and the spring piece 42 impinge against each other by 15° as the angle difference mentioned above. The ratchet wheel 34 is integrally formed with a gear 46. This gear 46 meshes with a pinion 47 which is pivoted on the both sides at the rear of the case 14. The pinion 47 rotates 90° at every 60° rotaton of the gear 46 according as the gear ratio of the pinion 47 to the gear 46 is set at 1:1.5. With the pinion 47 is integrally formed a cam 50. The cam 50 is of a nearly elliptic form, the major and minor axes of which each lie vertically or horizontally at every 60° rotation of the ratchet wheel 34. Against the face of the cam impinges the lower end of a follower 52 attached vertically and slidably to a supporting piece 51 extending from the back plate of the case 14. This follower 52 serves as a engaging means 7 in this embodiment and the follower 52 is energized downward by a spring. The above cam 50 further provides drive for an engaging piece 55. This engaging piece 55 is a rectangular plate within which a hole part rotatably receiving the cam 50 is provided, and is energized forward by a spring 56 being inserted between itself and the back plate of the case 14, wherein the rear of the hole part contacts slidingly with the cam 40, while the engaging piece 55 moves forward at the time of the aforesaid rear impinging against the face of the cam 50 on the side of the minor axis of the cam 50, whereby a protrusion 57 provided on the front end face fits in the above-mentioned engaging groove 31, thereby being able to lock the first lever 19. The first and second operating units 3, 4 each have their own handles **3*b*, 4*b*, and the supporting shafts 3*a*, 4*a* projecting from the respective centers of both operating units penetrate through the above-mentioned square holes and are fixed thereon, at the same time the first and second lever 19, 20 are energized in the direction of the forward inclination by springs, and stop as a rule in the standard position where the clearances 22*a*, 23*a* are left in the front parts of the guide grooves 22, 23, respectively. Incidentally, the handles 3*b*, 4*b* of the first and second lever 19, 20** each are held horizontally.

Figure 4:
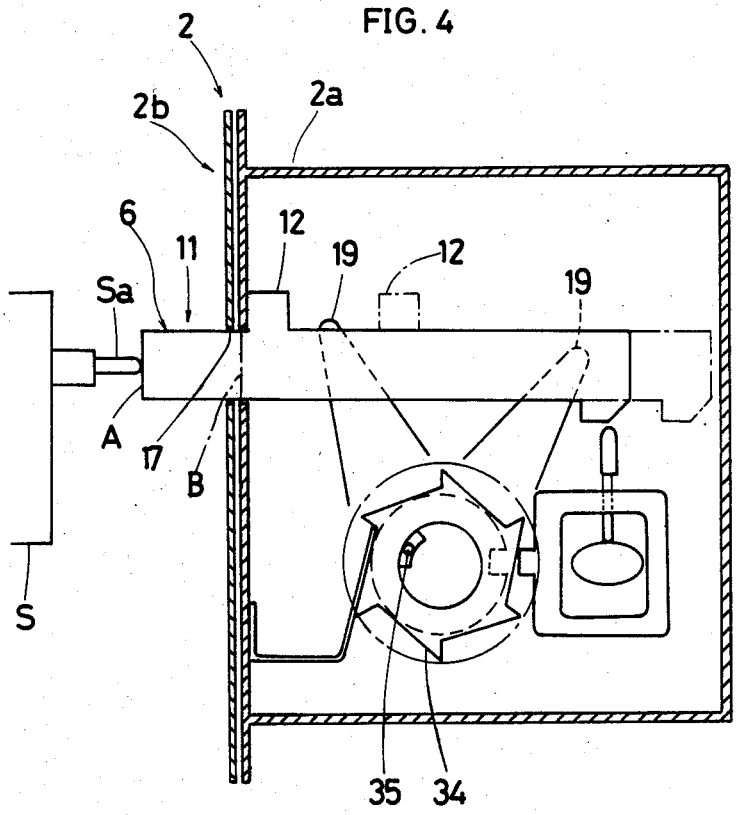
FIGS. 4, 5 and 6 are diagrams showing the working of the same.

As for the body of lock **2*a*, if the handle 3*b* of the operating unit 3 is operated, it first guides the first moves through the guide groove 22 rearward and then pushes back the end of the the guide groove, whereby the bolt 11 can freely go to and fro between from the wholly projecting position A where the striking piece 12 impinges against the front 13 to the door-opening position B where the end of the lock 11 is situated near the front 13 to be able to open and shut at will at any time (as shown in FIG. 4). In this case, the bolt 11 projects to the wholly projecting position A if the operating unit 3 is unhanded, so that the bolt 11 strikes against the periphery of the opening part of the wall at the time of the door D being shut, and in such a condition as it is, it is impossible to shut the door in a perfect sense. Therefore, the bolt 11 serves as a check piece 6 to prevent the door D from shutting. Also when stepping in the space $R_2$, the bolt 11 parts from the controlling means S by pulling the bolt 11 with the use of the first operating unit 3, whereby the electric circuit EC is closed. Further, during the shifting of the lock lever by using the first lever 19, the second lever 20 stands still in the clearance 23*a* of the guide groove 23**.

Figure 5:
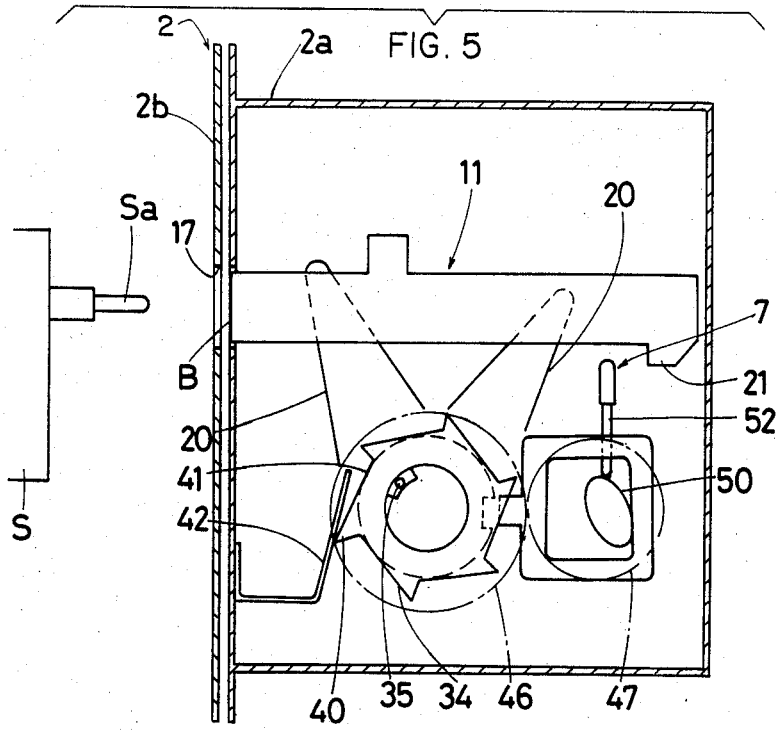
Figure 6:
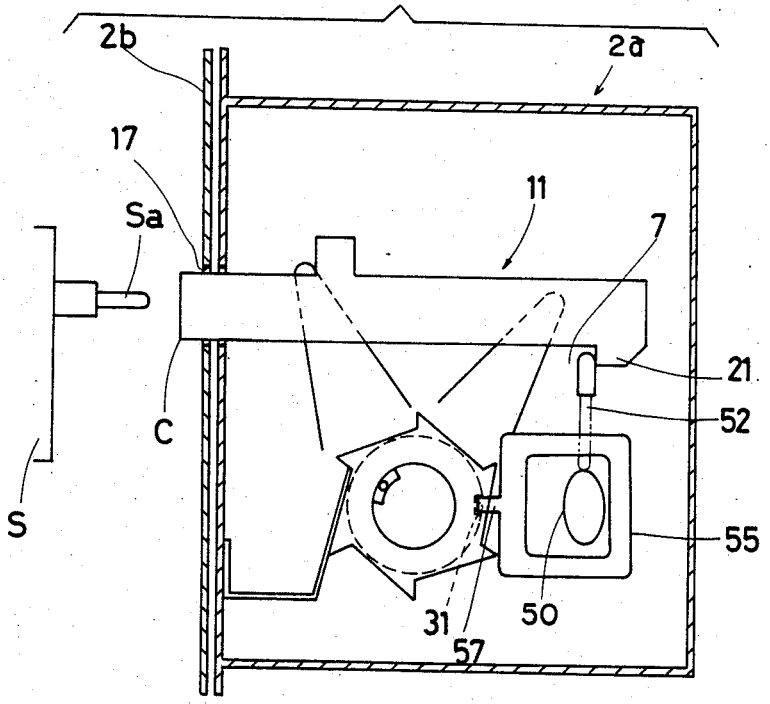

Next, in order to shut the door, the second lever 20 is made to incline backward by handling the second operating unit 4 on the inner side of the door. The second lever 20 forces the bolt 11 to go back by impinging against the rear end of the guide groove 23, and at the same time it makes the ratchet wheel 34 rotate in the same direction through the above-mentioned clutch pin 35. At the time of the 60° rotation of the ratchet wheel 34, one pawl part 40 is ridden across, while the cam 50 is made to rotate 90° holding the major axis vertical through the engagement of the gear 46 with the pinion 47, and further the second lever 20 is made to pass over the 60° position and to rotate, for example, as shown in FIG. 5, 75°, whereby the bolt 11 is made to go back up to the door-opening position B. By the way, in the 75° position the pawl part 40 is energized by the spring piece 42 in the reversed direction, and consequently the pawl part 40 returns properly to the 60° position where the spring piece 42 and the plane surface 41 impinge against each other in company with the reversal of the lever 20. On the way of return, the follower 52 pushed up by the cam 50 engages with the protrusion 21 and thereby holds the bolt 11 in the half-projecting position C, as shown in FIG. 6. As described above, the follower 52 functions as the engaging means 7 which can hold the bolt 11 at the half projecting postion C, in this example. The projecting length of the bolt 11 toward the receiving plate **2*b* in the half-projecting position C is smaller than that in the wholly projecting position A, while on the other hand the protrusion 57 of the engaging piece 55 slidingly provided on the minor axis of the cam 50 engages with the engaging groove 31 and thereby restrains the first operating unit 3. In consequence, the bolt 11 separates from the controlling means S, closes the electric circuit EC, and lights up the electric appliances E. Further, when retiring from the room, the cam 50 is made to rotate 90°, accordingly the following 52 is pressed down, and the engaging piece 55 is made to go back, by handling the second operating unit 4 in the same manner as above, whereby the bolt 11 is made to project up to the wholly projecting position A, and the first operating unit 3 can be released. As a result, the shutting operation of the door at the time of retiring from the room becomes possible by using the first operating unit 3; the bolt 11** projects up to the wholly projecting position A owing to the above shutting operation, presses the controlling means S, and opens the electric circuit EC, for example, puts out lights.

As mentioned above, the door installation according to the invention can put the electric circuit in the ON condition by handling, for example the operating unit 4 on the inner side of the door. Therefore, when the room is ill-lit, it can make the lighting of the room and others without taking much labor because of being able to use the operating unit 4 which can be recognized easily beforehand as to where it is placed. Besides, it can disconnect the electric circuit EC which conducts usually electricity to the electric appliances E in the space $R_2$ to produce the power saving effect by being able to light up only when necessary, and further it can also prevent the danger of leak and overheat caused by the neglect of lighting-out. What is better, it contributes to such an enhancement of operability that the electric circuit EC operates ON concurrently with the opening the door D and that because of being able to maintain the ON condition during the door-opening state, so that it can eliminate the sense of anxiety felt at the time of going in a ill-lit room, and so on. More than that it assures the shutting of the door D and hence the closing motion of the electric circuit EC because of the provision of the check piece 6. When operating the switch SO, it can force the electric circuit EC to operate ON, and consequently it can light up the electric appliances E regardless of the entrance and exit of the person. Therefore, even in such a case where a plurality of persons repeat going in-and-out at random as they go in at a time or go out individually, the lighting-up can be done by means of the switch SO so far as even a person remains in the room. The pilot lamp PL is for perceiving the state of lighting-up within the room $R_2$ and also for confirming the working of the controlling means S. FIGS. 7 to 11 show another example of the present invention using another type of locking device 2.

In all examples in this specification, the correspondent members will be indicated with the same numbers.

The bolt 11 is provided with a striking piece 12 which is formed by cutting away the upside of the bolt 11 at its front part, and with a guide groove 22 in the form of a long aperture. Further, the bolt 11 is provided with a stepped engaging part 25 facing to the side of the front 13 almost in the middle of the underside of the bolt. With this engaging part 25 interlocks an engaging means 7 in the half projecting position C of the bolt 11. The engaging means 7 is made of a plate spring and is attached to the bolt along its underside. This engaging means 17 forms a protrusion 7*a* being prevented from the engagement with the engaging part 25 as a rule by being turned slantingly downward.

Figure 9:
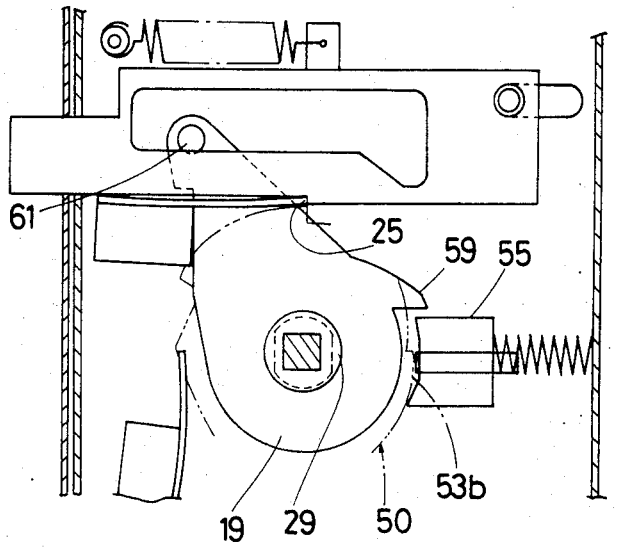
FIG. 9 is a front view in part showing a state where the engaging piece has advanced in the example shown in FIG. 7.
Figure 10:
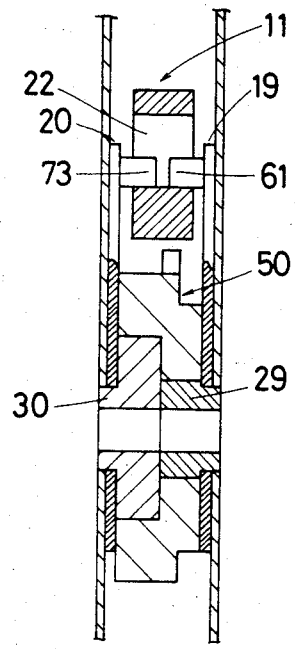
FIG. 10 is a cross-sectional view in the central part of the same of FIG. 7.
Figure 11A:
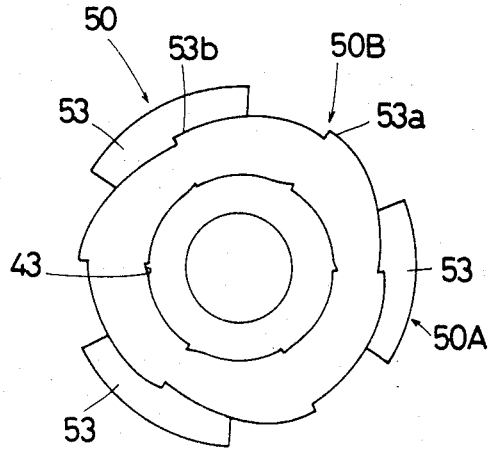
FIG. 11(*a*) is a front view illustrating the cam.
Figure 11B:
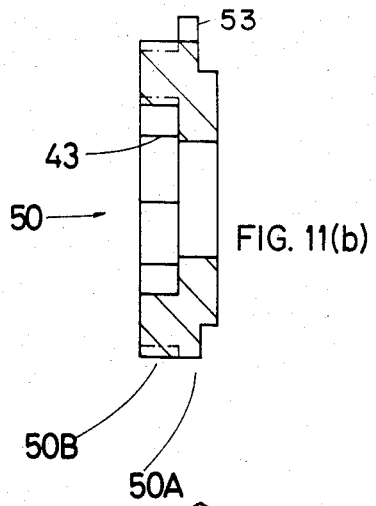
Figure 11C:
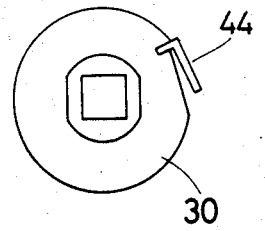

Into the above-mentioned guide groove 22 are inserted holding pieces 61, 73 attached to the front parts of the first and second levers 19, 20. These first and second levers 19, 20 are fixed on bossed parts 29, 30 being rotated by the first and second operating units 3, 4, respectively. On the bossed parts 29, 30 are mounted rotatably cams 50, 50. The cam 50 is provided, as shown in FIG. 11(*a*) (*b*), at its periphery with a cam face 50A having a bulging part 53 arranged at an angular pitch of 120° and with a cam face 50B having two kinds of bulging parts 53*a* and 53*b* different in projecting length arranged at an angular pitch of 60°. Along this cam face 50B is prepared a spring piece 42 which is to engage with the bulging parts 53*a*, 53*b*. On the other hand, the cam 50 is provided at its inner hole, where it engages with the bossed part 30, with a pawl groove 43. With this pawl groove 43 can engage a spring piece 44 (shown in FIG. 11(*c*)) installed in the bossed part 30. To the above-mentioned cam face 50B is attached an engaging piece 55 being energized forward by a spring, which moves forward by impinging against the lower bulging part 53*b*. This engaging piece 55 engages by its forward movement with a protrusion 59 provided at the rear part of the first lever 19, thereby, as shown in FIG. 9, checking the rotation of the latter. In a state where the bolt 11 lies in the wholly projecting position, the bulging part 53 remains in the situation not impinging against the engaging means 7. Consequently, when rotating and releasing the first lever 19, the holding piece 61 makes the bolt 11 freely go forward and backward between the wholly projecting position A and the door-opening position B, then it becomes possible for the person to go into the room. After the entrance, when the second lever 20 is turned, then the cam 50 rotates 60°, and the bulging part 53 of the cam face 50A stops in a state where the engaging means 7 is pushed up. Therefore, the engaging means 7 is able to engage the bolt 11 returning from the door-opening position B in the half-projecting position C (shown in FIG. 8). With the rotation of the cam 50, the engaging piece 55 impinges against the bulging part 53*b* and thereby can prevent the swing of the first lever 19, as described referring to FIG. 9. When retiring from the room, the cam 50 is put in rotation by operating again the second lever 20 and thereby returns to the state shown in FIG. 7, when the first lever 19 can be made to work again to shut the door D at the time of retiring from the room. It is possible in this way to engage the bolt 11 in the half-projecting position C by using the intermittently rotating cam 50.

FIGS. 12 to 16 show further the other examples of the present invention using the locking device 2 of a different type.

Figure 12:
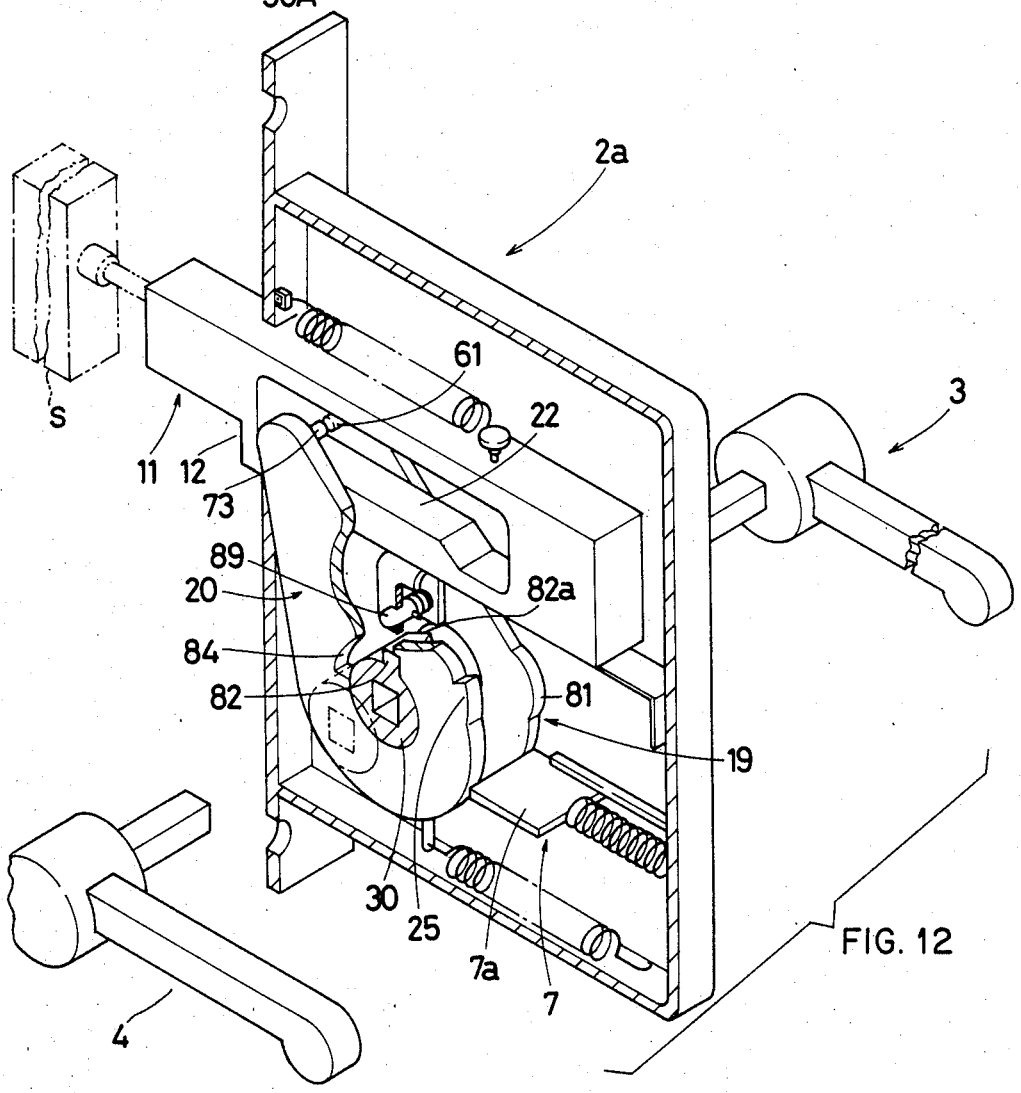
FIG. 12 is a perspective view broken-away in part of another example of the body of lock used in the door installation of the present invention.
Figure 15:
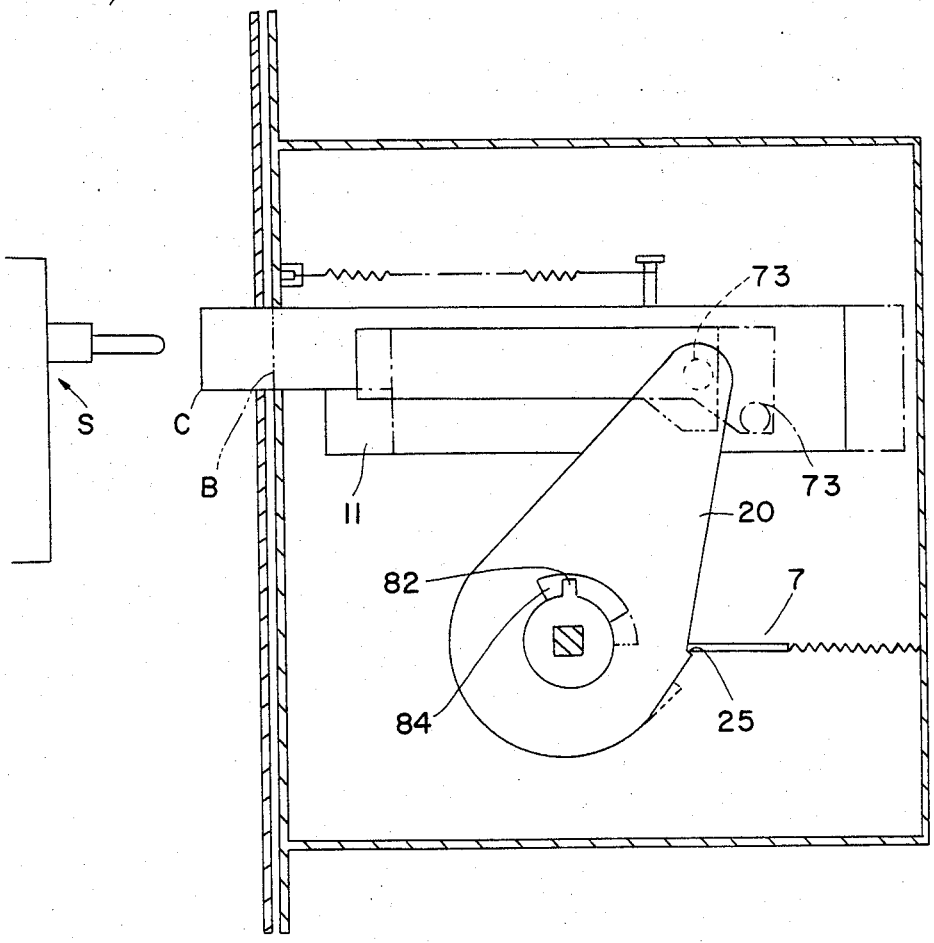

The bolt 11 here is provided with a stiking piece 12 being formed by cutting away the underside of the front end part and has a guide groove 22 extending in the longitudinal direction. Into this guide groove 22 is inserted holding pieces 61, 73 being provided on the front end part of the first and second lever 19, 20, respectively. The first lever 19 is secured fixedly on the bossed part 29 and is provided at the outer edge of its rear with a circular arc-shaped protruding part 81. The second lever 20 is installed rotatably on the bossed part 30, and is provided with a circular arc shaped notched groove 84 into which an engaging piece 82 mounted on the bossed part 30 can be inserted leaving a gap therebetween. This notched groove 84 comes at its rear in contact with the above-mentioned engaging piece 82 in the standard position where the second lever 20 inclines forward. The second lever 20 is also at an outer edge of the rear provided with an engaging part 25 relatively smaller in projecting length than the above-mentioned protruding part 81 changing the phase in the counter-clockwise direction, as shown in FIG. 12. The case 14 is provided with an engaging means 7 made of a plate body 7*a* being energized forward by a spring. This engaging means 7 engages with the the above-mentioned engaging part 25 at the time when the second lever 20 inclines backward, as shown in FIG. 15, and is able to maintain the state of the backward inclination of the second lever 20. The engaging means 7 can make contact with the first lever 19 slidingly, is made to go backward by the protruding part 81, and in this way separates from the engaging means 25.

On the inner side of the above-mentioned engaging piece 82 is provided an inclined surface 82*a*, which makes a lock pin 89 in the case 4 shift. The lock pin 89 shifts and fits into an engaging hole 90 being provided in the first lever 19, thereby being able to lock the first lever 19 in its state of the forward inclination.

Figure 16:
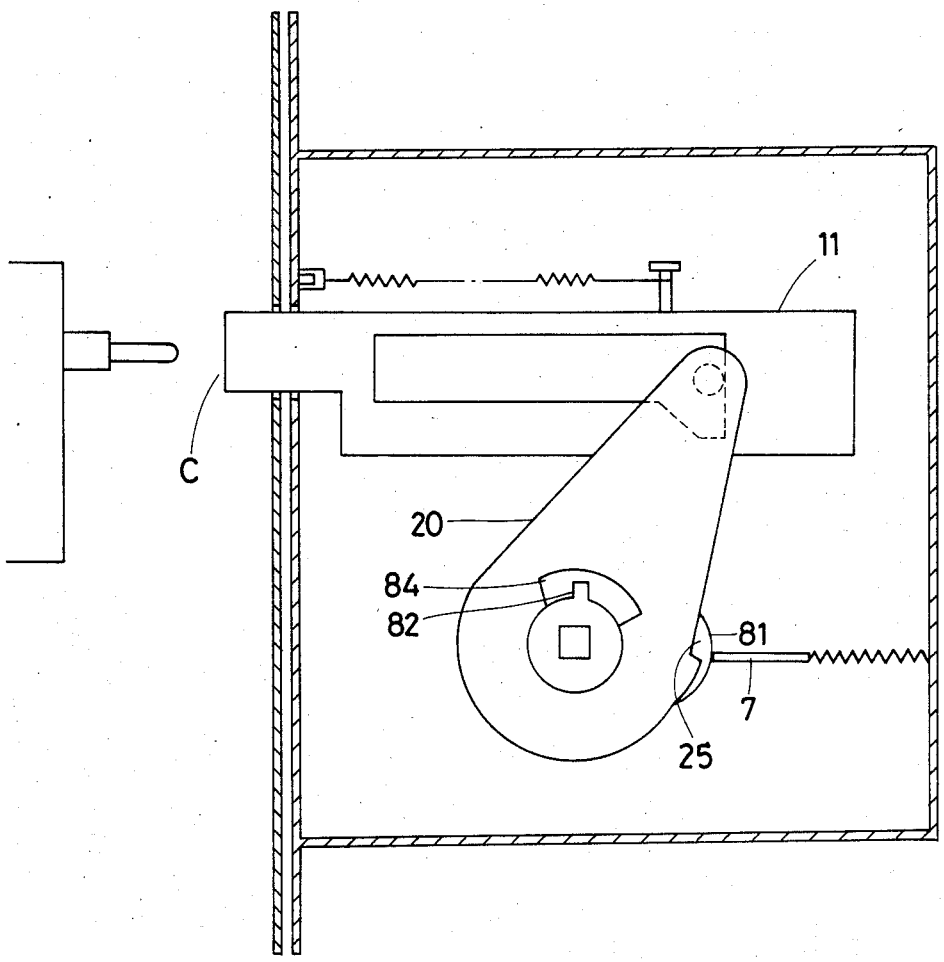
Figure 17:
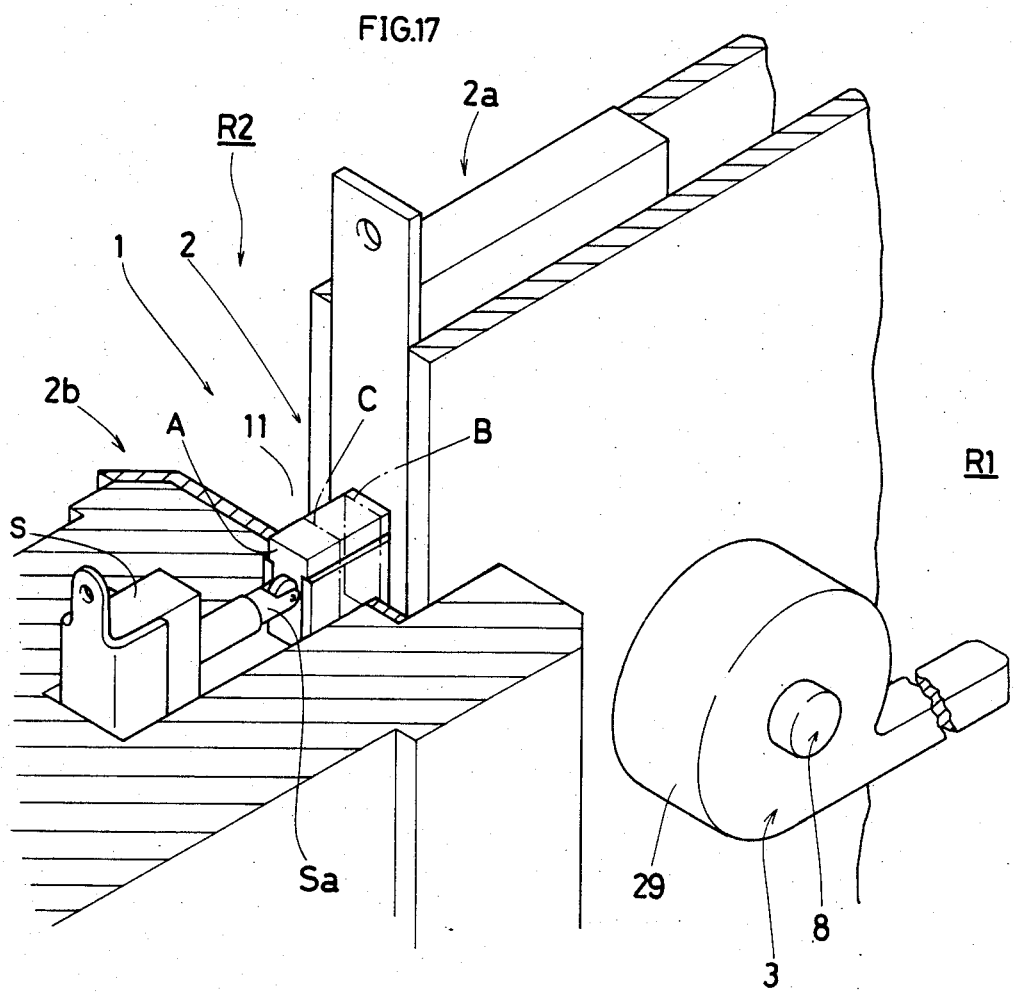
FIG. 17 is a perspective view showing a further example of the present invention.

In consequence, when handling the first operating unit 3 being fitted in the bossed part 29 and making the first lever 19 incline backward, then the holding piece 61 presses the rear of the guide groove 22 to shift the bolt 11 from the wholly projecting position A to the door-opening position B (shown in FIG. 14), when the controlling means S is put in the ON condition concurrently with this door-opening operation. On the other hand, by operating the second lever 20 on the inner side of the door through which the person has entered, the engaging piece 82 makes the second lever 20 incline backward, whereby the engaging means 7 engages with the engaging part 25 to be able to hold the state of the second lever 20 having inclined, as a result of which the bolt 11 is engaged in the half-projecting position C to continue to make the controlling means S operate ON. This state is kept likewise if the second lever is operated repeatedly. In this connection, the second operating unit 4 along is able to return to the standard condition because of having the notched groove 84. By making the second operating unit 4 in such a condition rotate over the standard condition in the counter-clockwise direction, the lock pin 89 can lock the first operating unit 3, as mentioned above. Next, by making the first operating unit 3 work after opening the door by handling the second operating unit 4 at the time of retiring from the room, the above-mentioned protruding part 81 forces the engaging means 7 to go back, when the latter separates from the former, as shown in FIG. 16. As the result, the first and second lever 19, 20 return to the original state, and the bolt 11 returns to the wholly projecting position A, whereby the controlling means S can operate OFF. In this example, if repeating the handling of the second operating unit 4, it is possible to hold the bolt 11 in the half-projecting position C. Accordingly, by handling the second operating unit 4 repeatedly, differing from a manner as in the above-mentioned examples in FIGS. 1 to 11, it is practicable to prevent the bolt 11 from going back and forth alternately between from the wholly projecting position A to the half-projecting position C. Or the lighting on-and-off can be performed properly even when the process of entering and retiring from the room is different from the oridinary one, by way of example, such as shutting the door re-opened after entering into the space $R_2$, in the case as of cleaning the interior of the space $R_2$ The device according to the invention also is applied to the case of an opening-out door which opens from the side of the space $R_2$ toward the side of the space $R_1$.

FIGS. 17 to 23 show still a further example of the present invention in the case of using a door partitioning two spaces $R_1$ and $R_2$ where a plurality of person go in and out at random. In this case, the locking device 2 is equipped with a power supply-maintaining means 8.

Figure 3:
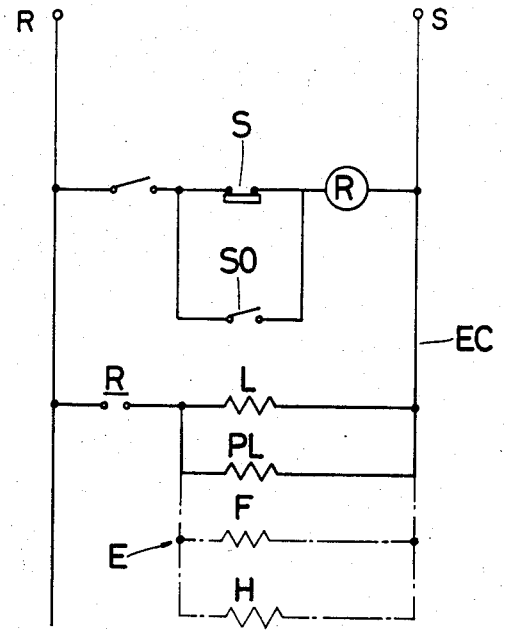
FIG. 3 is an electric circuit diagram.

The door installation according to the present invention is such a one as to work the controlling means S connected to the electric circuit EC shown in FIG. 3 by using the first and second operating units 3, 4 being arranged on both sides of the door D and as to be able to make the above controlling means S maintain the ON condition by means of the power supply-maintaining means 8. The door D opens and shuts the wall W partitioning off, for example, the space $R_1$ such as the corridor and the space $R_2$ such as the living room, and is formed as an opening-in door which opens from the space $R_1$ to the space $R_2$.

The bolt 11 can go back and forth between the wholly projecting position A where the striking piece 12 impinges against the front 13 and the door-opening position B where the door D can be opened by pulling the bolt 11 to the side of the front 13 making it merge for the most part into the front 13. The bolt 11 is provided at its head part 11*a* with a buffering member 5, and has erected on its upper face an engaging piece 24 which is provided concavely at its upper end face with an engaging part 25. The bolt is cut away at its under face, and is provided with a groove 26 which is formed at its rear face into an impinging face 26*a*. The engaging piece 24 is pressed down by the holding pieces 61, 73 which are facing each other at the head parts of the first and second lever 19, 20 to make the bolt 11 go back and forth. The above-mentioned holding piece 61 of the first operating unit 3 is formed in a long size, and its head extends beyond the above-mentioned engaging part 25. The above-mentioned first and second levers 3, 4 are provided extending from the concentric bossed parts 29, 30 of the first and second operating units 3, 4, respectively. The center of the above-mentioned bossed parts 29, 30 are situated at the height of the nearly middle part of the above-mentioned groove part 26.

On the suspension piece of the case 14 is pivoted the engaging means 7 made up of a lever 7*c*. This engaging means 7 is energized downward by a spring, and it is able to hold the bolt 11 in the half-projecting position C between the wholly projecting position A and the door-opening position B, by making its stepped part in the rear which engages with the engaging part 25. In this holding position, the holding piece 61 pushes up the engaging means 7 by operating the first lever 19. Therefore, the handling of the first operating unit 3 can not make the engaging means 7 engage with the engaging part 25, but conversely, even when the both engage with each other, it can release their engagement. Incidentally, the head part 11*a* of the bolt 11 is formed into a check piece 6 whose side faces all are made parallel, so that it becomes necessary to make the lock 11 go back without fail at the time of shutting after once opened. In the receiving plate 26 attached to the vertical frame F is housed the controlling means S.

The above-mentioned power supply-maintaining means 8 consists of an engaging pin 91 floatingly inserted into the bossed part 29 in such a manner as not to drop out, shown in FIG. 18, and a pushing-out piece 92 formed within the inner side of the bossed part 30, shown in FIG. 19. The engaging pin 91 engages the impinging face 26*a* of the above-mentioned groove part 26 while projecting, and thereby is able to engage the bolt 11 in the half-projecting position C. The pushing-out piece 92 is made out of a screw shaft which is screwed in a screw cylinder projecting from the inside of the bossed part 30 and is checked from turning by a non-turning piece 93. This pushing-out piece 92 is able to push back the above-mentioned engaging pin 91 having projected through the slight rotation of the bossed part 30 to its original position.

In the door-shutting state where no incomer stays in the space $R_2$, the controlling means S is being pressed at its working head Sa by the projecting bolt 11 and is in the OFF condition, when the electric circuit EC opens and the electric appliances all are lighted out.

Figure 20:
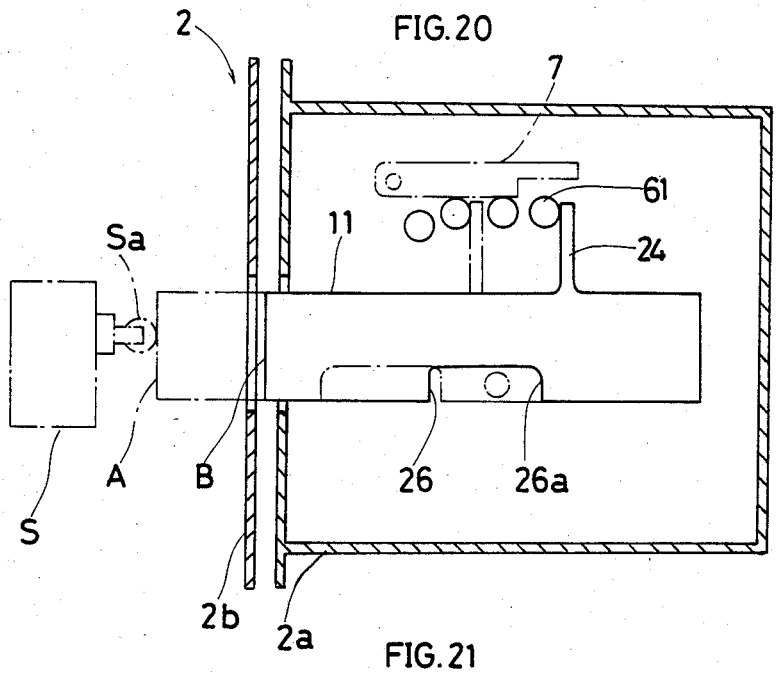
Figure 21:
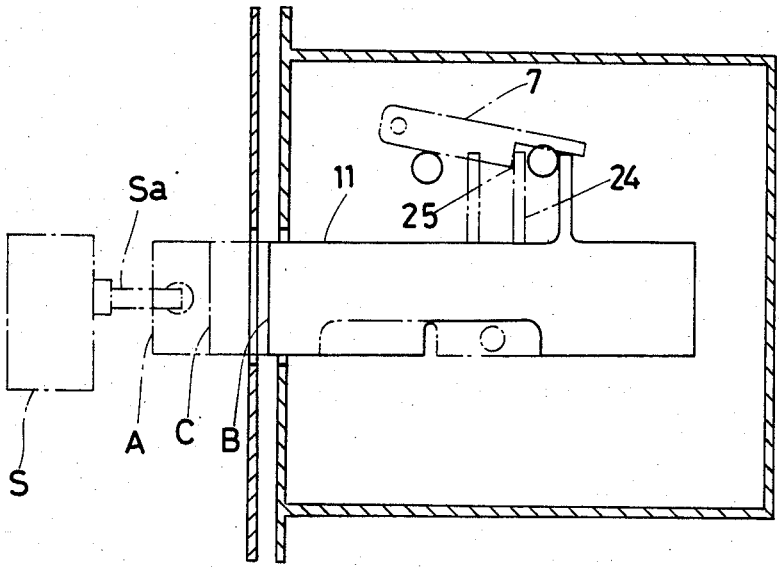

Now at the time of going out of the space $R_1$ into the space $R_2$, if the handle 3*b* of the first operating unit 3 is pulled down, the holding piece 61 of the first lever 19 makes the bolt 11 go back up to the door-opening position B, as shown in FIG. 20, when the door D can be opened. Concurrently with the retreat of the bolt 11, the switch S operates ON. As mentioned above, the engaging means 7 and the engaging part 25 do not engage with each other in this case even if handling the first operating unit 3, in consequence of which the bolt 11 can be made to go back and forth with freedom by using the first operating unit 3.

After opening the door D, at the same time when entering the space $R_2$, the first operating unit 3 is unhanded and the second operating unit 4 is gripped anew and then the door D is shut by using its handle 4*b*. In such a free state as in this time, the head part 11*a* of the bolt 11, that is, the check piece 6 left as it is projecting up to the wholly projecting position A, so that it is necessary to operate the second operating unit 4 without fail in order to shut the door. After shutting the door, if the second operating unit 4 is unhanded, the above-mentioned engaging means 7 engages with the engaging part 25 (shown in FIG. 21) to make the bolt to be situated in the above-mentioned half-projecting position C. In this case, if repeating to work the second operating unit 4, there is still produced the same state as above, and throughout the time of operating the first operating unit 3 for the purpose of retiring from the room, the bolt 11 maintains the half-projecting state C. After opening the door for going out of the room, the bolt 11 project by handling the operating unit 3 on the side of the space $R_1$, and puts the controlling means S in the OFF condition.

In the case of one incomer having already stayed in the room, another one who is about to go therein can release the engagement of the engaging means 7 with the engaging part 25 done by the precedent incomer by handling the first operating unit 3 to open the door. However, by this door-opening operation, bolt 11 is made to retreat and the lighting state is maintained. On the other hand, at the time of retiring from the room leaving the one who is staying there as he is, by pushing the engaging pin 91 of the power supply-maintaining means 8 at the time of handling the first operating unit 3, the bolt 11 is made to engage in the half-projecting position C, as shown in FIG. 22, and the lighting state is maintainable as it is. Incidentally, because the buffering member 5 is attached to the bolt 11, it lessens the shock and prevents the bolt from being damaged even if the door D is shut strongly by mistake. This buffering member 5 is made up of thin plate of rubber and the like, is fitted in a shallow groove 11*b* and is adhered by the use of some adhesives, as shown in FIG. 23(*a*). Or it is possible for it to be attach to only one single side of the bolt 11 by being divided into two pieces and each being put to the upper and lower sides, separately, as shown in FIG. 23(*b*), otherwise by interposing a cushion 5*a* as shown in FIG. 23(*c*). This treatment can be utilized also in the case of an opening-out door D which opens from the space $R_1$ to the space $R_2$ as it is.

As shown in this example, it is possible to maintain the lighting condition by providing with the power supply-maintaining means 8, if desired.

Figure 24:
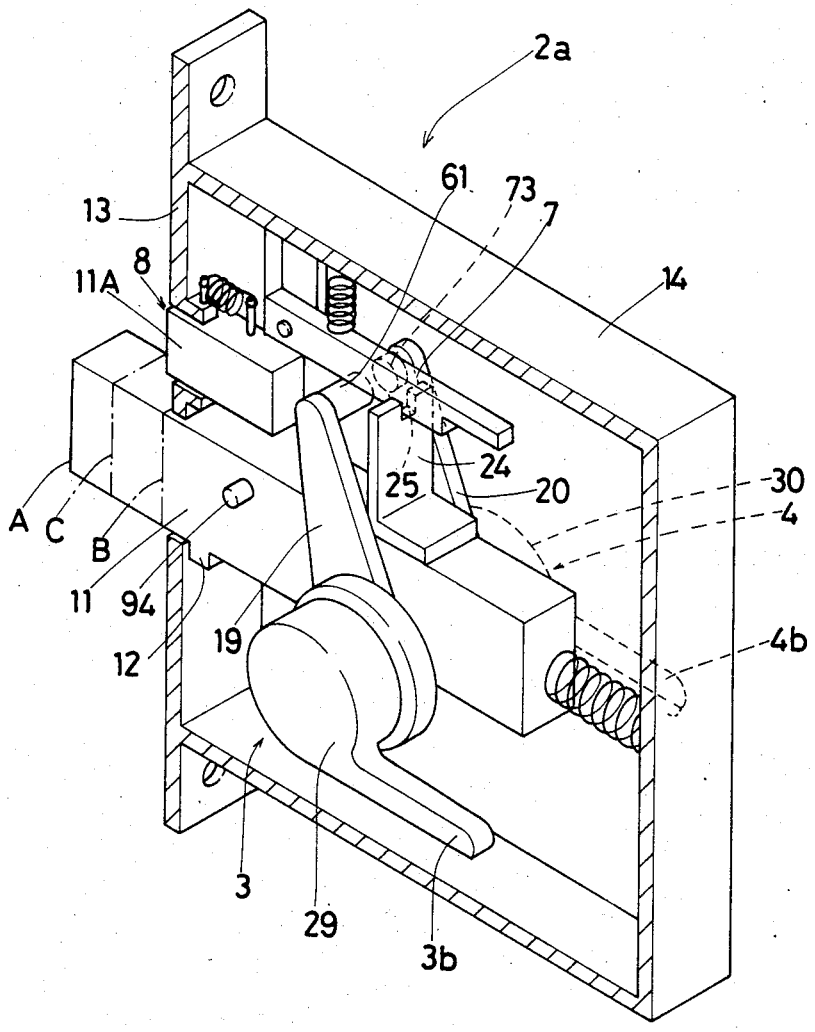
FIG. 24 is a perspective view broken-away in part showing another example of the body of lock usable in the door installation of the present invention.
Figure 25:
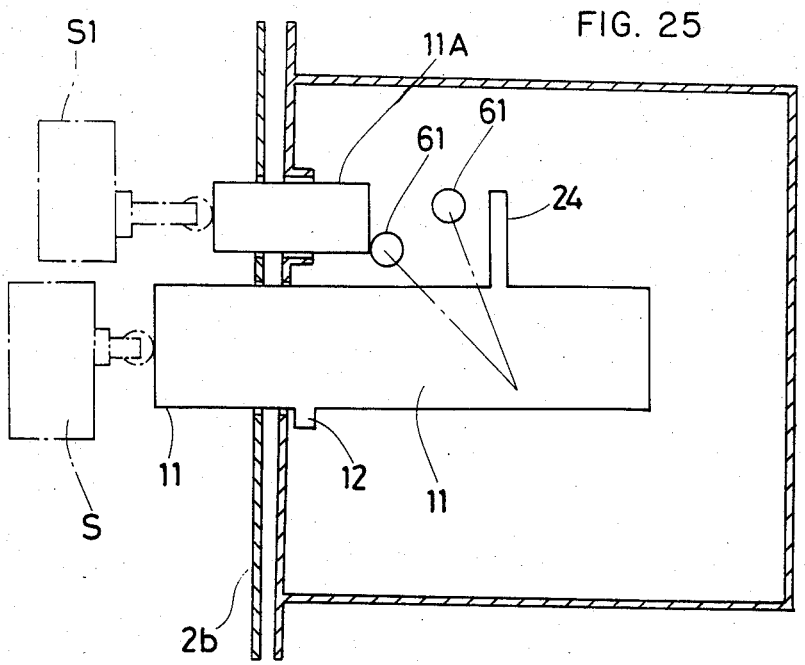
FIG. 25 is a diagram showing the working of the same.
Figure 26:
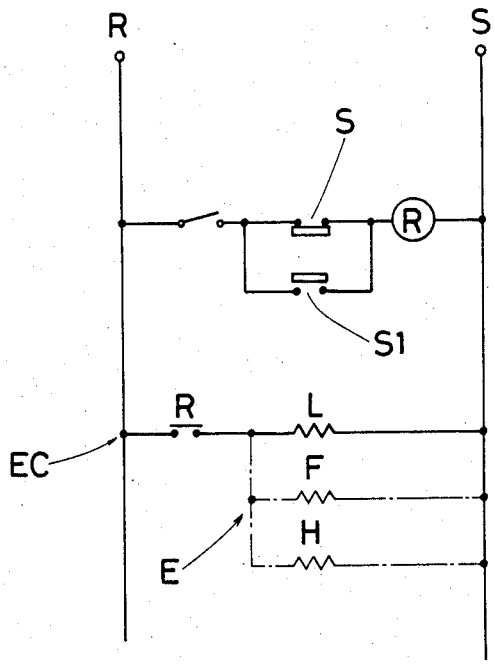
FIG. 26 is an electric circuit diagram of the same.
Figure 27:
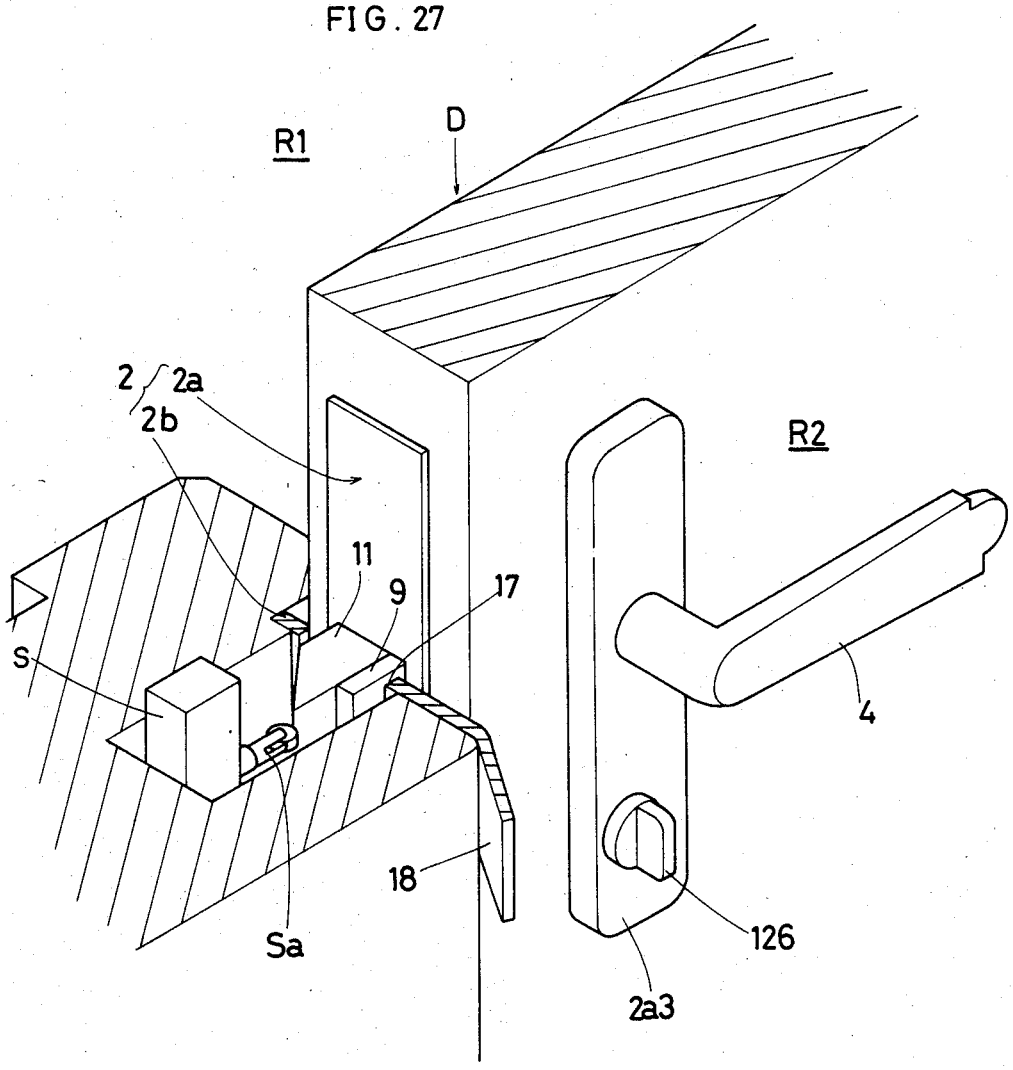
FIG. 27 is a persepctive view further showing another example of the present invention.
Figure 31:
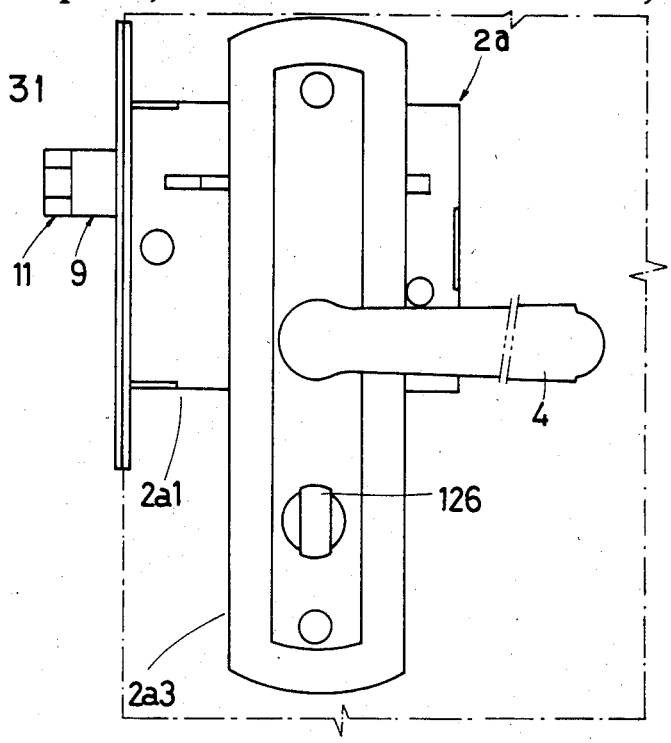
FIG. 31 is a right-side view thereof.

FIGS. 24 to 26 show yet another example of the invention being used in the case where a plurality of persons enter the room or retire therefrom at random.

In the case 14, there is provided with the bolt 11 and its auxiliary bolt 11A below and above. The auxiliary bolt 11A is energized to the inside of the case 14 by a spring, and can project from the front 13 by a pushing piece 61 which is provided on the head part of the first lever 19 of the first operating unit 3. On the side of the bolt 11 is provided a protruding pin 94. This protruding pin 94 is able to return the first lever 19, which is inclined forward for pushing-out the above-mentioned auxiliary bolt 11A, in the return stroke of the bolt 11 to the standard state. Inside the receiving plate 2, in addition to the controlling means S is provided an auxiliary controlling means S1, as shown in FIG. 25. The normal closed controlling means S and the normal opened auxiliary controlling means S1 are parallel-connected, as shown in FIG. 26, so that they are able to continue to light up the electric appliances by jerking up the first operating unit 3 when going out of the room. In a word, the auxiliary bolt 11A forms the power supply-maintaining means 8. Incidentally, the other structure of the locking device 2 in this example is constructed almost in the same manner as the one where the power supply-maintaining means 8 is taken away from the example shown in FIGS. 17 to 23.

FIGS. 27 to 46 show still a further example of the present invention. The example here is provided with a releasing means 9 which can release automatically the bolt 11 being held in the half-projecting position C by handling the operating unit on the inner side of the door, and which can return it to the wholly projecting position A at the time of retiring from the room.

The door installation 1 is provided with the locking device 2 consisting of the door of lock 2*a* and the receiving plate 2*b*. The body of the lock 2*a* is provided with the bolt 11, the engaging means 7, and the releasing means 9.

The body of lock 2*a* in this example is provided with a body part 2*a*1 being embedded in to the side of the front surface of the door D, and the exterior parts 2*a*2 and 2*a*3 each being attached to the both side surfaces of the door D correspondingly to the above body part 2*a*1. This body part 2*a*1 has at the rear of the front 13 a case 14 which is provided with a shallow receiving part 14*b* which is covered at its one side by a cover plate 14*a*.

The bolt 11 is shaped in the form of a latch bolt having the head part 11*a* which is slantingly cut away at its outside face, and is provided at the under face of its rear with the engaging part 25. Further, on the bolt 11, the triangular protrusions 95, 96 tapering toward the head part are mounted on the external and internal sides. Besides, the bolt 11 is provided with a guide groove 22 being excavated through along its external and internal sides. At the head part 11*a*, the buffering member 5 made of such material as synthetic resin or rubber is adhered fixedly to a striated groove 11*c* extending up to the guide groove 22, inclusive of the above-mentioned slant face.

The bolt 11 is provided at its inner side with timing bolt 9*a* serving as the above-mentioned releasing means 9. The releasing means 9 is provided, as specified in FIGS. 38 and 39, at the long piece part 97 as thick as the above-mentioned protruding part 96 on its inner side both the protruding piece 98 being able to be inserted into the above-mentioned guide groove 22 and the receiving piece 99 being situated on the upper part of the bolt 11 and extending backward. This releasing means 9 is able to go back and forth through the case 14 along the bolt 11 by inserting protruding piece 98 into the guide groove 22. The bolt 11 can shift between the wholly projecting position A and the door-opening position B. The releasing means 9 is able to project forward while extending its long piece parts 97 beyond the front 13.

Beneath the bolt 11 is arranged the engaging means 7, on the external side of it the first lever 19, and on the internal side of it the second lever 20.

Figure 37:
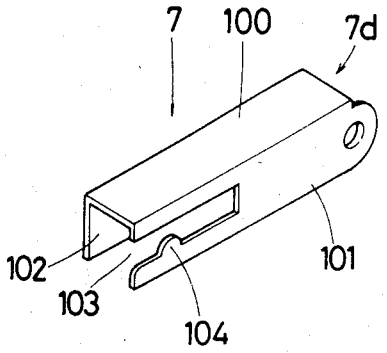
FIG. 37 is a perspective view illustrating the engaging means.
Figure 38:
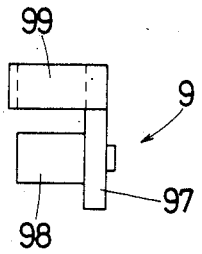
FIG. 38 is a front view showing the releasing means.
Figure 39:
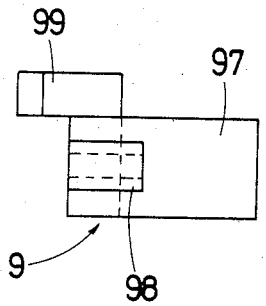
FIG. 39 is a left-side view thereof.

The engaging means 7 is an arm 7*d* of a turning downward U-shape in cross-section suspending two rectangular plate-shaped side pieces 101, 102 on the both sides of the upper piece 100, and its head is supported on the case 14 so as to be able to oscillate. At the side piece 101 is provided a groove part 103 which is open at the rear end, as shown in FIG. 37, and at the lower side of the groove part 103 is formed a turned-up protrusion 104. The engaging means 7 is energized upward by a spring, and the rear end brink of the above-mentioned upper piece 100 engages with the engaging part 25 of the bolt 11. Through this engagement, the bolt 11 is engaged in the half-projecting position C where the head part 11*a* of the bolt 11 only projects practically from the front 13.

The first lever 19 is rotatably pivoted on the bossed part 29 being fitted in the first operating unit 3 on the exterior part 2*a*2. At the head part of the first lever 19 is mounted in pin-shaped holding pieces 60, 61, and at the lower part of them is provided a protruding piece 62 on the same radial line as of the push pieces 60, 61. The push piece 60 is situated nearly right back of the receiving piece 99 of the releasing means 9 in the standard state of the first lever 19 inclining forward, while the push piece 61 is inserted into the above-mentioned guide groove 22. In this connection, the first lever 19 is energized toward the front 13 by a spring, so that it makes the releasing means 9 project forward. Further, on the first lever 19 are formed a pawl piece 105 and a protruding piece 106 which impinges against the bottom plate of the receiving part 14*b* to make the first lever 19 be held in the above-mentioned standard state. The above-mentioned pawl piece is to be pressed down by a protruding piece 107 being provided on the above-mentioned bossed part 29.

The above-mentioned push piece 61 presses the rear face of the guide groove 22 with the swing of the first lever 19. As a result, the bolt 11 goes back and forth between the wholly projecting position A and the door-opening position B. On the other hand, the above-mentioned protruding piece 62 presses down the above-mentioned protrusion 104 of the engaging means 7 to separate the engaging part 25 and the engaging means 7 at the time the protruding piece 62 makes the bolt 11 go back to the vicinity of the half-projecting position C. Also in the return stroke after once having passed over the protrusion 104, the protruding piece 62 can press down the protrusion 104. Aside from this, the protrusion 104 can be pressed down in the vicinity of the half-projecting position C by the push piece 60 being pressed against the receiving piece 99 of the retreating releasing means 9. That is, the releasing means 9 can set the engagement of the engaging means 7 with the bolt 11 free in the vicinity of the half-projecting position C of the bolt 11, otherwise it can prevent their engagement.

The above-mentioned second lever 20 is fixed fast on the bossed part 30 into which is inserted the supporting shaft of the second operating unit 4 being provided on the exterior part 2*a*3. The second lever 20 is provided at its head part with a pin-shaped push piece 73 which is inserted into the guide groove 22. Accordingly, it is also possible to make the bolt go back and forth between the wholly projecting position A and the door-opening position B by the turning of the second operating unit 4.

Figure 40:
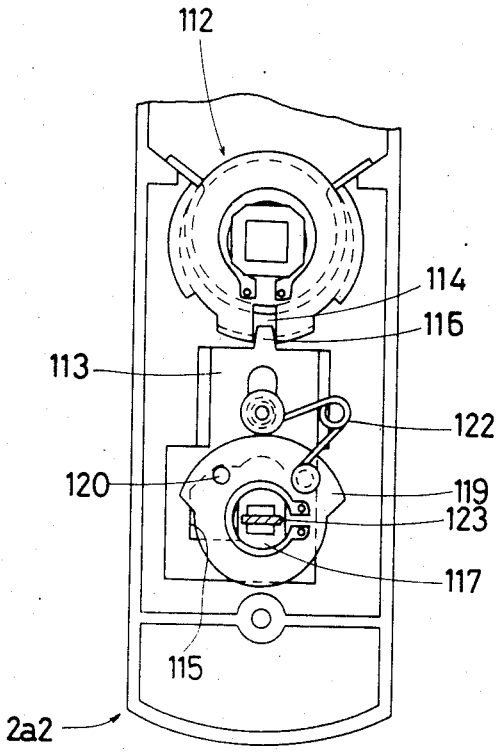
FIG. 40 is a front view showing the locking device.
Figure 41:
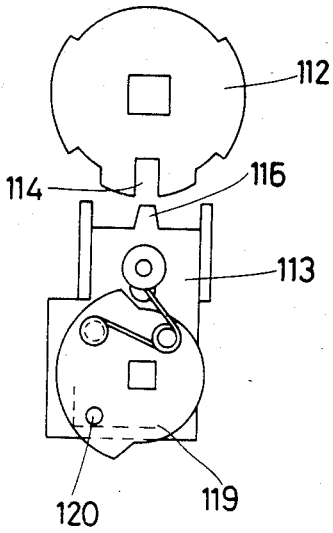
FIG. 41 is a diagram showing the working thereof.

At the above mentioned exterior parts 2*a*2, 2*a*3 is provided a keying means 110. This keying means 110 is equipped with an engaging wheel 112 on the cylinder shaft into which the supporting shaft is inserted, and an engaging plate 113. The engaging wheel 112 has at its lower end an engaging groove 114. It is possible to constrain the first operating unit 3 unrotatably in a horizontal state by inserting a protrusion 116 on the upper brink of the engaging plate 113 into the engaging wheel 112, thereby being able to lock up. In this connection, the engaging plate 113 has a cut-away hole 115, into which a driving pin 120 is provided on a rotary plate 119 of a square cylinder shaft 117. Therefrom, as shown in FIGS. 40 and 41, the engaging plate 113 can move up and down by the upper and lower brinks of the cut-away hole 115 being pressed by the action of the driving pin 120 in response to the rotation of the rotary plate 119. The engaging plate 113 is pressed elastically at its above and below positions, respectively, by a torsion spring 122. The square cylinder shaft 117 extends to another exterior part 2*a*3 through the interposition of a joint piece 123. On the above-mentioned square cylinder shaft 117 of the exterior part 2*a*2 is mounted an urgency button 125 having a split groove in which a coin can be dropped, while on the side of the exterior part projects a thumb turn 126.

On the other hand, at a receiving plate 2*b* is provided an engaging hole 17 into which the bolt 11 and the releasing means 9 can be insert together, and on the inner end brink of the receiving plate 2*b* is provided with a projecting a guide part 18 bending outward.

Description will be now directed, by way of example, to the case where the door D is partitioning the outward space $R_1$ like a corridor and the inward space $R_2$ such as a toilet and the like.

Figure 32:
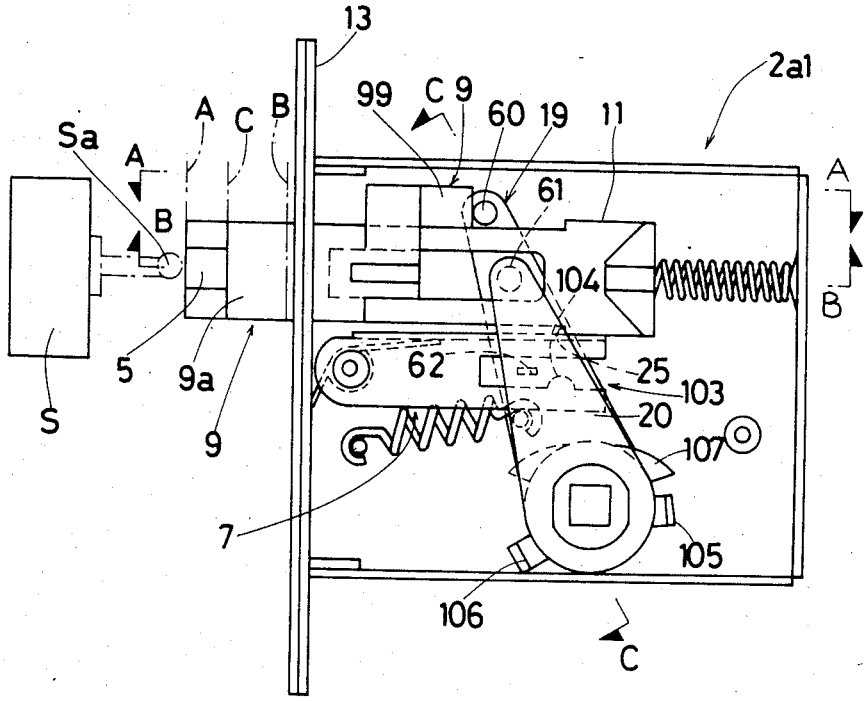
FIG. 32 is a front view showing the same in FIG. 29 while taking the side of it away.
Figure 33:
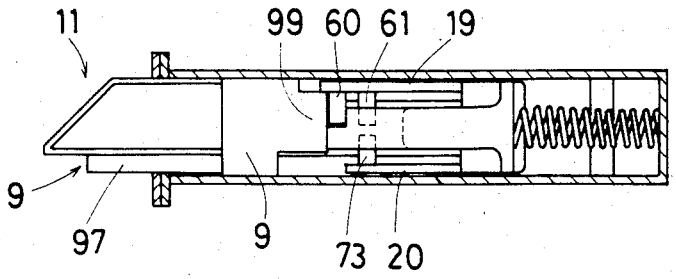
FIG. 33 is a sectional view thereof taken on the line A—A.
Figure 34:
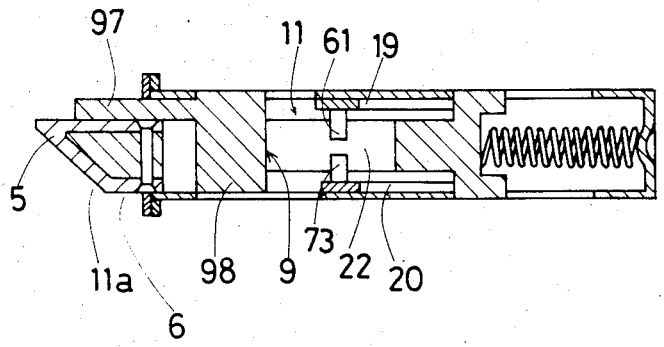
FIG. 34 is a sectional view thereof taken on the line B—B.
Figure 35:
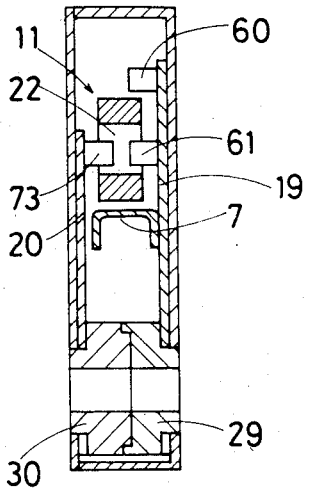
FIG. 35 is a sectional view thereof taken on the line C—C.
Figure 36:
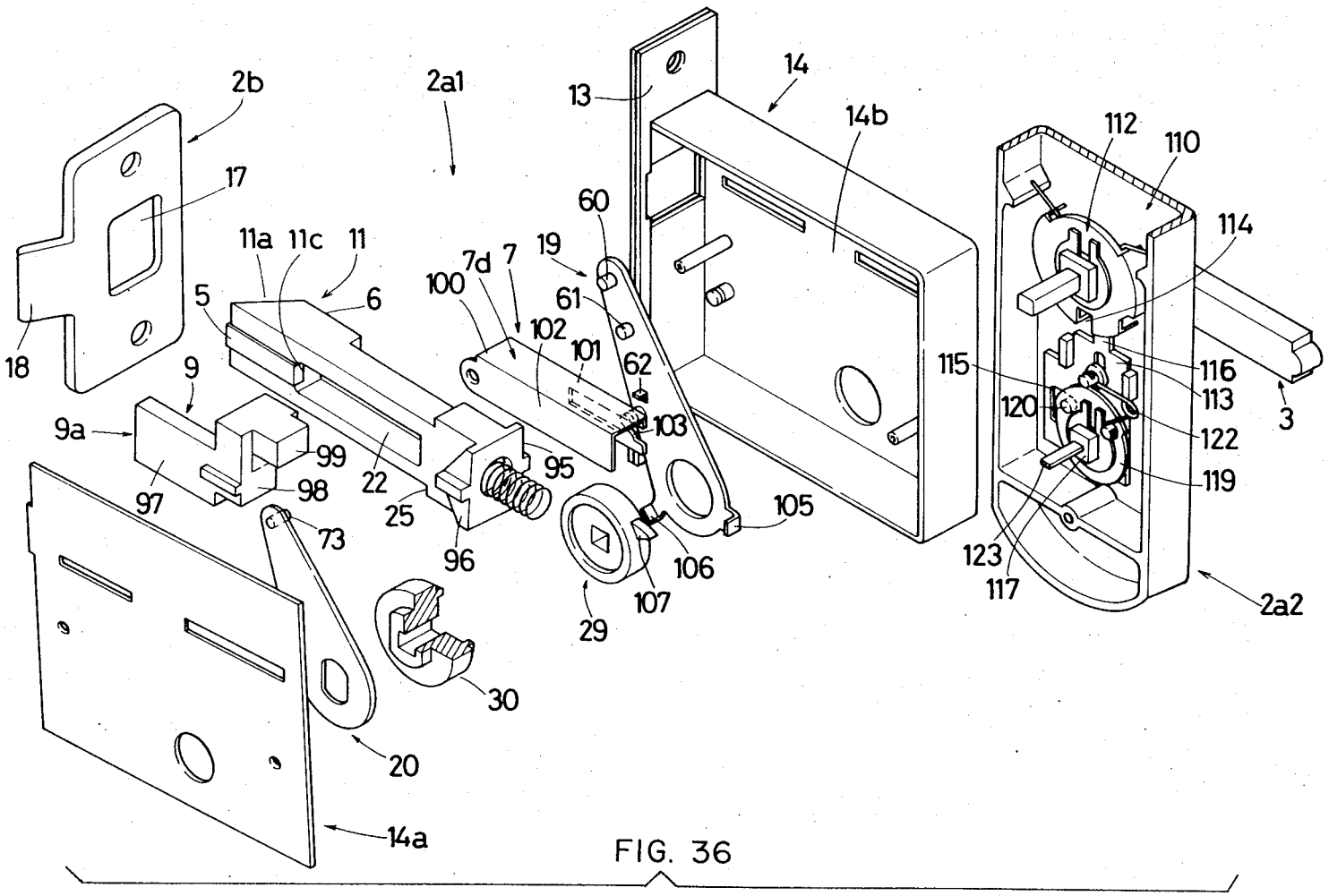
FIG. 36 is an exploded view in perspective.

In the case of the door shutting state of the space $R_2$ where the person is absent, the first operating unit 3 and the second operating unit 4 both lie horizontal, and the first lever 19 and the second lever 20 both are situated in the standard position shown in FIG. 32, when the bolt 11 is OFF by pressing the working head Sa of the controlling means S.

Figure 42:
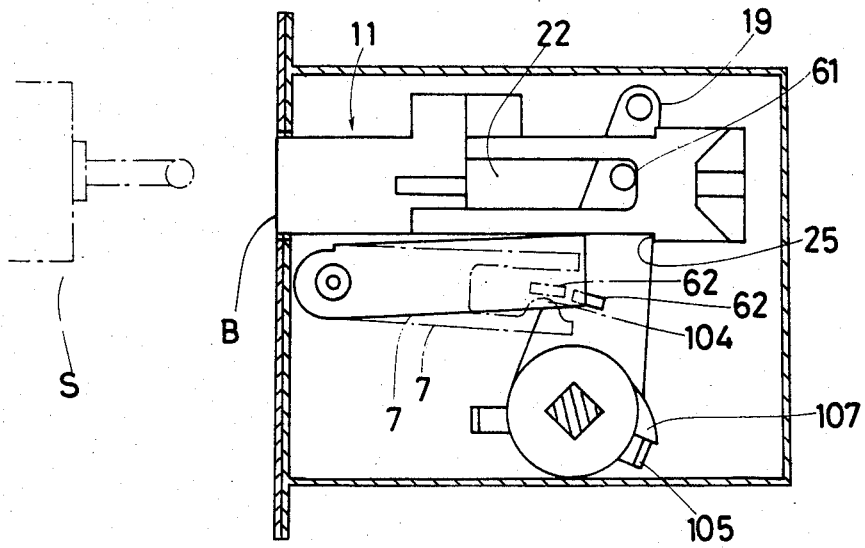
FIGS. 42 to 45 are diagrams showing the working.
Figure 43:
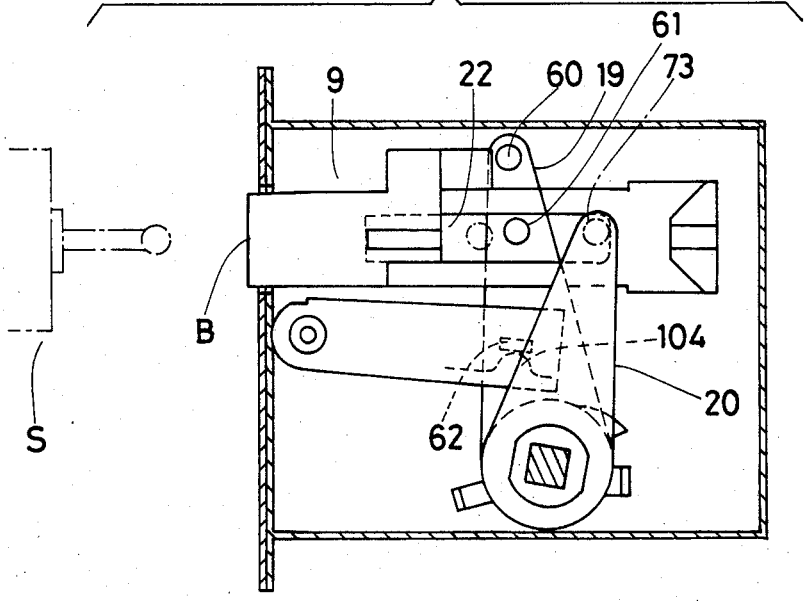

At the time of entering the room, the first operating unit 3 first is turned. The first lever 19 is inclined through a pawl piece 105 and a protruding piece 107, as shown in FIG. 42, to shift the bolt 11 up to the door-opening position B by the lower push piece 61 pressing the rear face of the guide groove 22. After the first operating unit 3 is unhanded. The protruding piece 62 of the first lever 19 presses down the protrusion 104 in the vicinity of the above-mentioned half-projecting position C, as shown by the chain line. That is, the lock lever 11 is made to go back and forth with freedom by the first operating unit 3.

Figure 44:
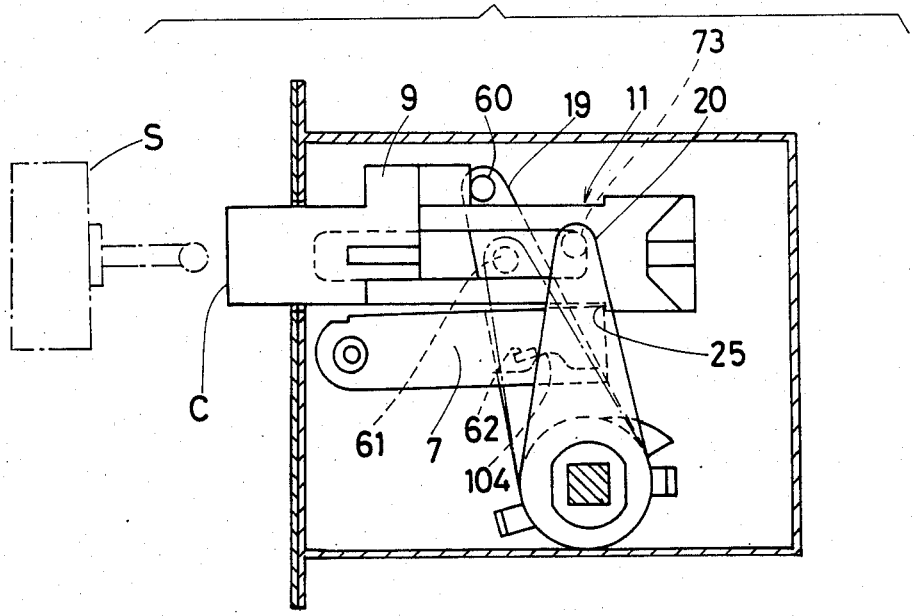

After going in the room, when the second operating unit 4 is gripped to rotate, the push piece 73 of the second lever 20 makes the bolt 11 go back to the door-opening position B. In this case, the releasing means 9 also goes back and makes the first lever 19 slightly rotate (at this time, the first lever 19 is mounted on the bossed part 29 rotatably, so that the first operating unit 3 keeps on lying in the horizontal state), but, as shown in FIG. 44, when the bolt 11 returned thereby up to the half-projecting position C, then the protruding piece 62 has been through with the passing over the protrusion 104. Accordingly, at the time of the bolt 11 going onward, the engaging means 7 engages with the engaging part 25, whereby it becomes possible to engage the bolt 11 in the half-projecting position C and to put the controlling means S in the ON condition.

Next, in the case of retiring the room, the second operating unit 4 is operated and thereby the door is opened. After going out of the room, if the first operating unit 3 is gripped and the door is pulled, the bolt 11 and the releasing means 9 impinge together against the guide part 18 of the receiving plate 2*b* and are pushed in the inner side of the case 14 and reach the door-opening position B.

Figure 45:
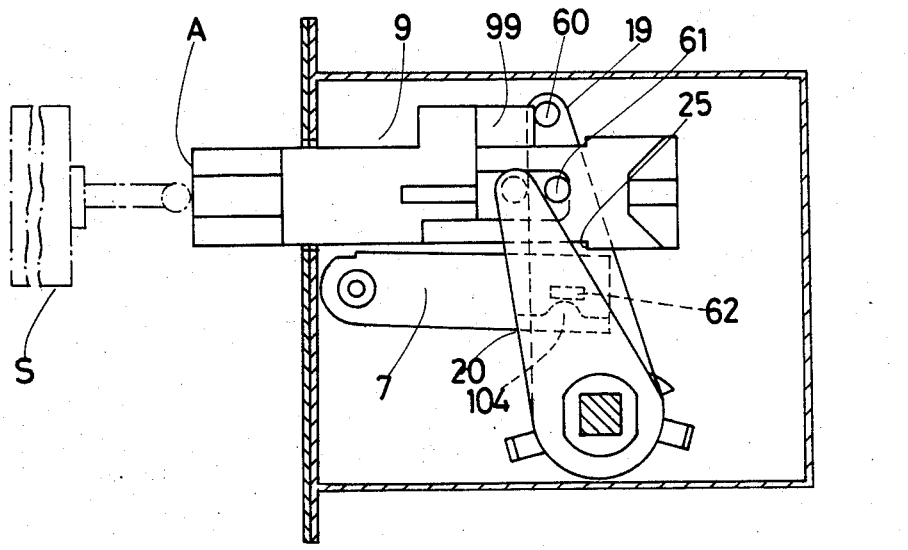
Figure 48:
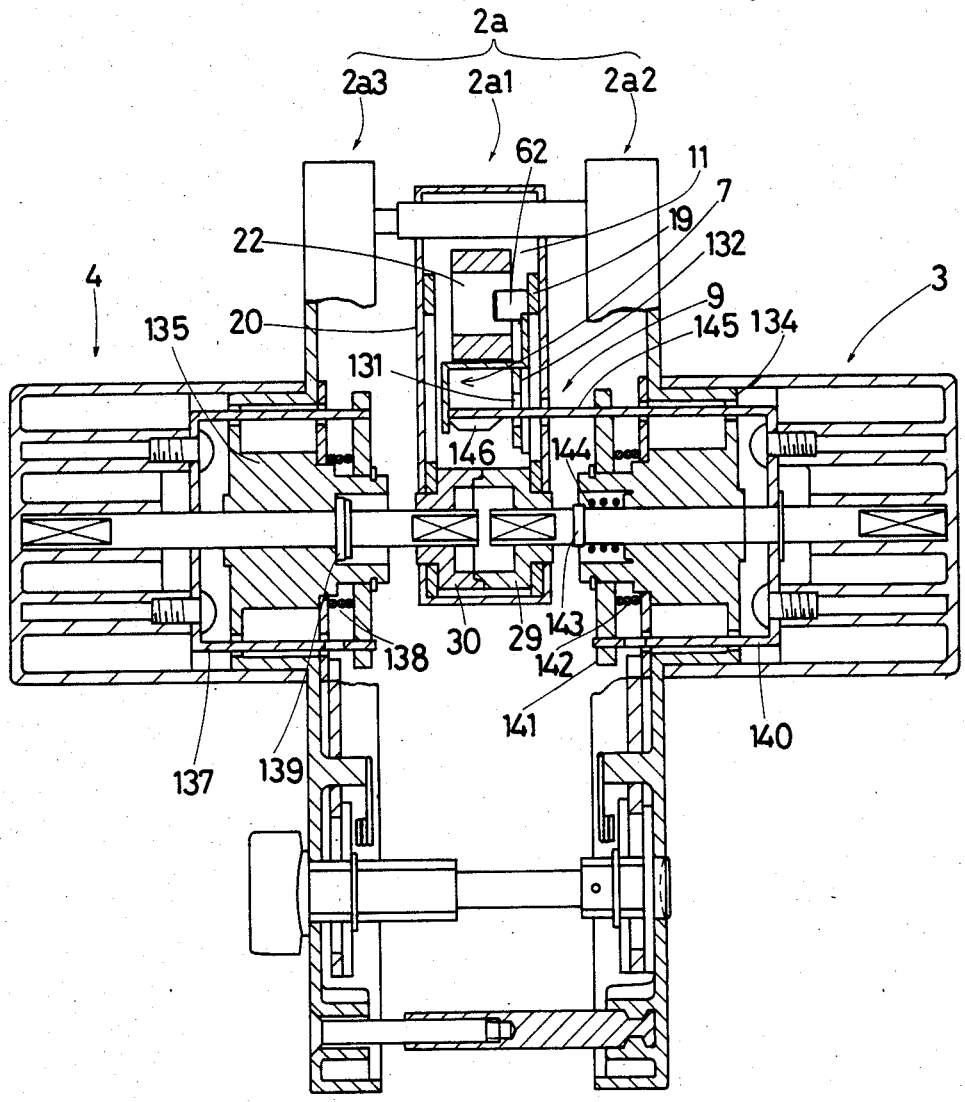
FIG. 48 is a sectional view of the body of the lock being used in the example in FIG. 47.

In the half projecting state C, the bolt 11 projects only its own triangular head part, so that it is guided by the receiving plate 2*b* with easiness. In this connection, in the wholly projecting position, the parallel part in the inner side of the head part 11*a*, that is, the check piece strikes on the receiving plate 2*b* so as to prevent the door D from shutting. Then, just before the door is shut, the bolt 11 goes ahead and reaches the position of the engaging hole 17 in the receiving plate 2*b*, as shown in FIG. 46, thereby going forward. However, the first lever 19 is held by the releasing means 9, and the protruding piece 62 pressed down the protrusion 104, as described above, so that the releasing means 9 separates the engaging means 7 through the first lever 19, as shown in FIG. 45. Consequently, the bolt 11 extends up to the wholly projecting position A and returns to the above-mentioned standard state by the releasing means 9 fitting in the engaging hole 17.

Incidentally, the locking operation comes to be done properly with the help of a locking device 110.

The provision of the releasing means 9 in this example can dispense with the rotational operation of the operating unit 4 in shutting the door and, what is more, the operation of opening and shutting the door and also of lighting on and off is facilitated on account of being able to operate OFF by the mere pulling of the door D.

The locking device 2 in this example is also used for the opening-out door D as it is. In this case, $R_1$ is replaced with $R_2$ and $R_2$ with $R_1$ in FIG. 27, while an urgency button 125 is equipped in place of a thumb turn 126.

FIGS. 47 to 55 show yet another example of the present invention, wherein the door D is used for partitioning, for example, the space $R_1$ as a corridor and the space $R_2$ as a toilet and the like, and it is constructed in the form of what is called an opening-in door which opens toward the space $R_2$, in the same way as in the above mentioned example. In this example, it is possible to simplify the operation of the operating unit on the side whereto the person passes through, namely, the operating unit on the side of the space $R_2$ when he gets in from the space $R_1$ to the space $R_2$. Contrary to this, at the time of retiring from the room, there is made convenient the operation of the operating unit located on the side of the space $R_1$ reverse to the space $R_2$.

The door installation 1 comprises a locking device consisting of a body of lock 2*a* and a receiving plate 2*b*. This body of the lock 2*a* has a body part 2*a*1 and exterior parts 2*a*2, 2*a*3.

The bolt 11 is of a latch bolt-shape having a head part 11*a* which is cut away slantingly at the side of the space $R_1$. Similarly to the example shown in FIG. 27 to 46, the bolt 11 is provided with an engaging part 25, protruding parts 95, 96, and a guide groove 22, while a buffering member 5 is attached to the head part 11*a*.

At both sides of the bolt 11 rise each first and second lever 19, 20, and beneath the bolt 11 is arranged an engaging means 7. The first and second levers 19, 20 are mounted unrotatably on bossed parts 29, 30 concentrically disposed, respectively. Further, the first and second levers 19, 20 push with their upper parts the above-mentioned 95, 96 and thereby are able to shift the latter between the wholly projecting position A and the door-opening position B.

The engaging means 7 is made up of an arm 7*e* of a U-shape in cross-section which suspends side pieces 101, 102 on both sides from an upper piece 100, and is supported at its head part on a case 14 in such a manner as to be able to vibrate. To the side piece 101 is formed an extended piece 132 having a circular arc-groove 131 concentric with the bossed parts 29, 30. On the side piece 101 further rises a protruding part 104 which is formed at its rear part in the form of a circular arc and at its top part in a slope lowering gradually toward the front 13. The engaging means 7 is energized by a spring and engages at its rear end with the engaging part 25 of the bolt 11. As a result of their engagement, the bolt can be held in the half-projecting position C. The protruding part 104 of the engaging means 7 is pushed downward by a pin-shaped protruding piece 62 being provided on the upper part of the first lever 19, and thereby the engaging means 7 separates from the engaging part 25 of the bolt 11, as shown in FIG. 52. When the bolt 11 lies also in the vicinity of the half-projecting position C, the protruding piece 62 is able to push down the protrusion 104. Accordingly, the bolt 11 can go back and forth with freedom without being held in the half-projecting position C.

The above-mentioned exterior parts 2*a*2, 2*a*3 are provided with the knob-shaped first and second operating units 3, 4, respectively. The first and second operating units 3, 4 each are attached rotatably to their own protruding parts 134, 135 concentrical with the above-mentioned bossed parts 29, 30 being provided on the exterior parts 2*a*2, 2*a*3. The second operating unit 4 is protected from coming off on the basis that a fixture 137 screwed in its inside is fixed fast with a disc fitted on the reverse side of the protruding part 135.

Further, the second operating unit 4 is energized by the torsion spring 138, is held in a position of a fixed angle, and is protected from coming off by the projected part 139 of its own supporting shaft.

Figure 49:
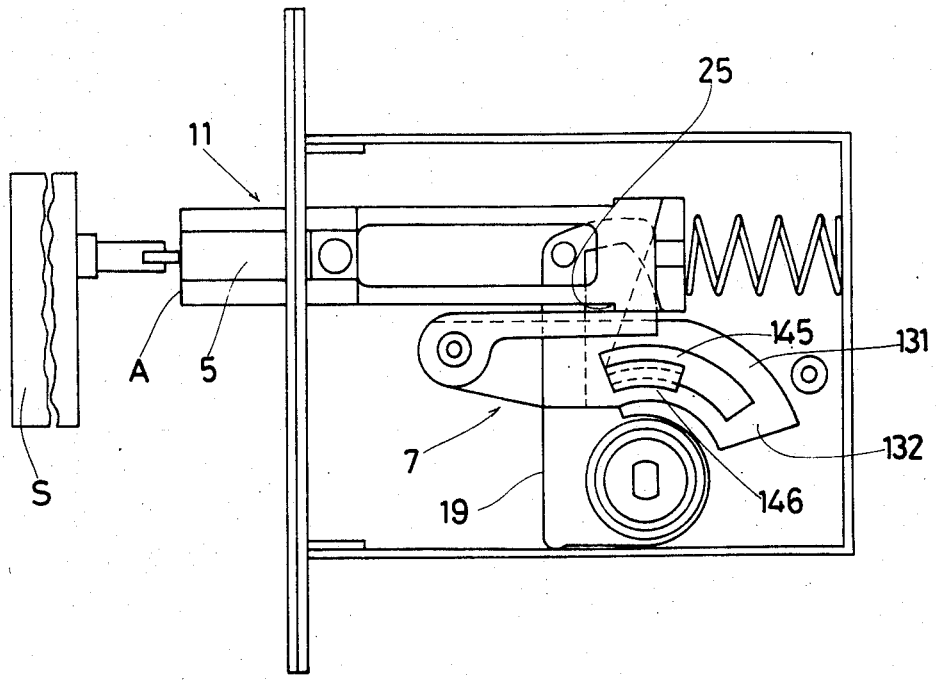
FIG. 49 is a front view of the body of the lock thereof showing while taking away its one side.
Figure 50:
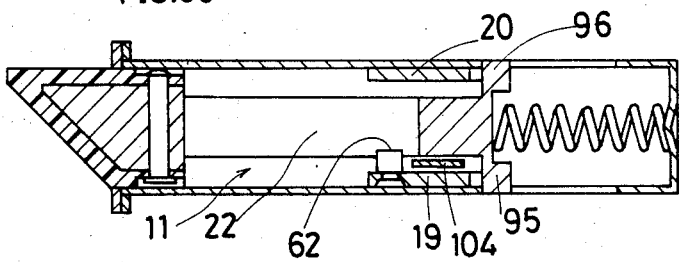
FIG. 50 is a cross-sectional view thereof.

On the other hand, a fixture 140 is screwed also on the first operating unit 3. The fixture 140 is inserted into a disc 141 being floatingly inserted on the reverse side of the protruding part 134, and the first operating unit 3 is energized by a torsion spring 142 and is held in a position of a fixed angle. The first operating unit 3 can also shift along the protruding part 134 outward, and is protected from coming off by the protruding part 143 of the supporting shaft, while it is energized inward by a spring 144 mounted on the protruding part 143. In this way, the first operating unit 3 can shift outward against the spring 144. The fixture 141 is provided with a protruding piece 145 piercing through the case 14 and entering into the above-mentioned circular arc-groove 131. The protruding piece 145 is provided at the under surface of its head part with a bulging part 146. This bulging part 146 impinges upon the under side of the above-mentioned circular arc groove 131 by pulling the first operating unit 3, and push the engaging means 7 downward. In a word, the fixture 140 constitutes the above-mentioned releasing means 9. The protruding piece 145 shifts through the circular arc groove 131 from end to end along with the rotation of the first operating unit 3. At this time, the first and second operating units 3, 4 are connected to the bossed parts 29, 30 through the medium of the supporting shaft, and therefore can swing the first and second lever 19, 20, respectively. Now, the working of the door installation in this example will be described in the following:

In the door-shutting state where no one stays in the space R, the lock bolt 11 presses the controlling means S, as shown in FIG. 49, and puts the electric circuit EC in the OFF condition.

Now, at the time of entering the room, when the first operating unit 3 is rotated, the first lever 19 inclines rearward through the supporting shaft. As a result, the lock lever 11 goes back up to the door-opening position B, thereby the door is able to be open, as shown in FIG.

Figure 53:
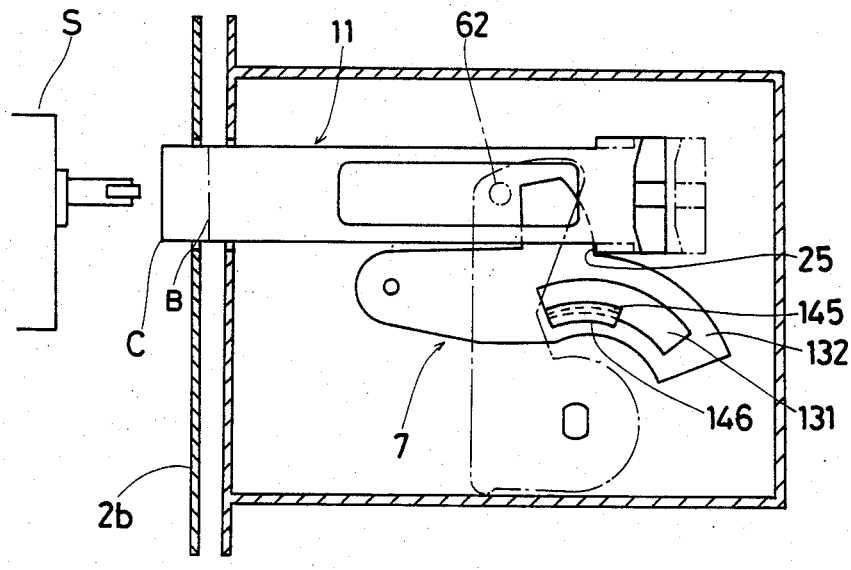
Figure 54:
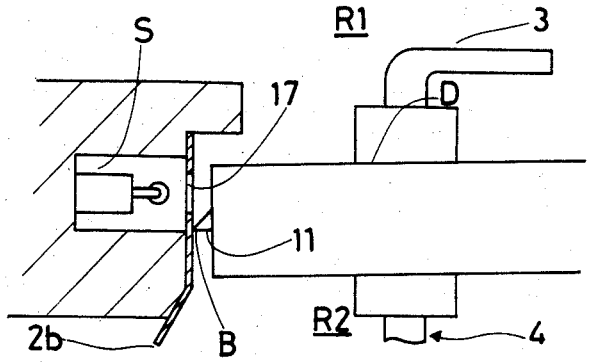
FIG. 54 is a sectional view showing the working.

52. As mentioned above, because of the protruding piece 62 pushing the protrusion 104 of the engaging means 7 downward, the lock lever 11 and the engaging means 7 do not engage. Accordingly, if unhanding the first operating unit 3, the lock lever 11 can project up to the wholly projecting position A. After entering the room, when the door D is pushed then the lock lever 11 comes to touch the receiving plate *2b*. Just before the door is shut, the lock lever 11 is pushed in the inner part, but nearly up to the vicinity of the door-opening position B, as shown in FIG. 54. In this case, the first lever 119 does not incline, and therefore the protruding piece 62 lies in a position apart from the protrusion 104. Consequently, when the lock lever 11 penetrates into the engaging hole 17, then the engaging part 25 of the lock lever 11 is engaged with the engaging means 7, whereby the lock lever 11 is held in the half-projecting position C, as shown in FIG. 53, and the electric circuit EC continues to operate ON.

In such a way, in the present example, unlike all of the precedent examples, the lock bolt 11 can be made to be held in the half-projecting position C, for example, only by pushing the door D back without the necessity of making the second operating unit 4 operate. Of course, it is apparent to be able to make the lock lever 11 engage likewise in the half-projecting position C also in the case of rotating the second operating unit 4.

Now in retiring the room, the lock lever 11 is made to go back up to the door-opening position B by the second operating unit 4 through the second lever 20, thereby the door is opened. Even when the hand is off after the door is opened, the lock lever 11 lies in the half-projecting position C. Subsequently, after retiring from the room, if pulling the first operating unit 3, the bulging part 146 provided on the protruding piece 145 of the fixture 140, that is, of the releasing means 9 pushes down the engaging means 7, as mentioned above. Accordingly, if the hand is off after having shut the door, the lock lever 11 projects up to the wholly projecting position A. As a result, it returns to the standard state shown in FIG. 49. Incidentally, instead of pulling the first operating unit 3, also in case of make the first operating unit 3 rotate, the protruding piece 62 of the first lever 19 can push down the engaging means 7, thereby being able to make the lock lever 11 return to the wholly projecting position A.

FIGS. 55(*a*) and (*b*) show another example of the first operating unit 3 and the exterior part *2a2*. The first operating unit 3 is mounted on a sphere 151. In the sphere 151, there is formed on the reverse side an engaging groove 152 having a depth reaching the center. Into this engaging groove 152 is inserted a supporting shaft 154 being connected to the center of rotation of the first lever 19. This supporting shaft 154 passes through the center of the sphere 151 and is pivotally supported at its both ends so as to be able to swing on a pin projecting from both the spherical surfaces above and below of the sphere 151. The pin 155 is supported on bearing pieces 158, 158 which fitted shiftably into the respective circumferential grooves 157 being provided on the upper and lower sides of a cylinder-shaped exterior case 156 in the circumferential direction, whereby the first operating unit 3 can rotate on the vertical plane. The sphere 151 is provided on its side with a wing piece 160 having a circular arc groove 159. By the way, in this example, the engaging means 7 is provided at its side piece 101 with an engaging hole 161. A bulging part 146 which is provided on the turned-downward head part of a connecting piece 164 looks in at this engaging hole 161, while the other end of the connecting piece 164 is made to be engaged with the above-mentioned circular arc groove 159. Further, the connecting piece 164 is supported so as to be movable only forward and backward. Incidentally, the above-mentioned wing piece 160 is able to rotate in the cut-away part 166 being provided within the radius of the exterior case 156.

In this way, the first operating unit 3 is able to swing the first lever 19 by rotating a handle *3b* in the vertical plane. When the handle *3b* is pulled the bulging part 146 goes foward and can push down the engaging means 7. Accordingly, the first operating unit 3 in this example may be adopted as a substitute of the cap-shaped one shown in FIGS. 47 and 48.

Figure 56:
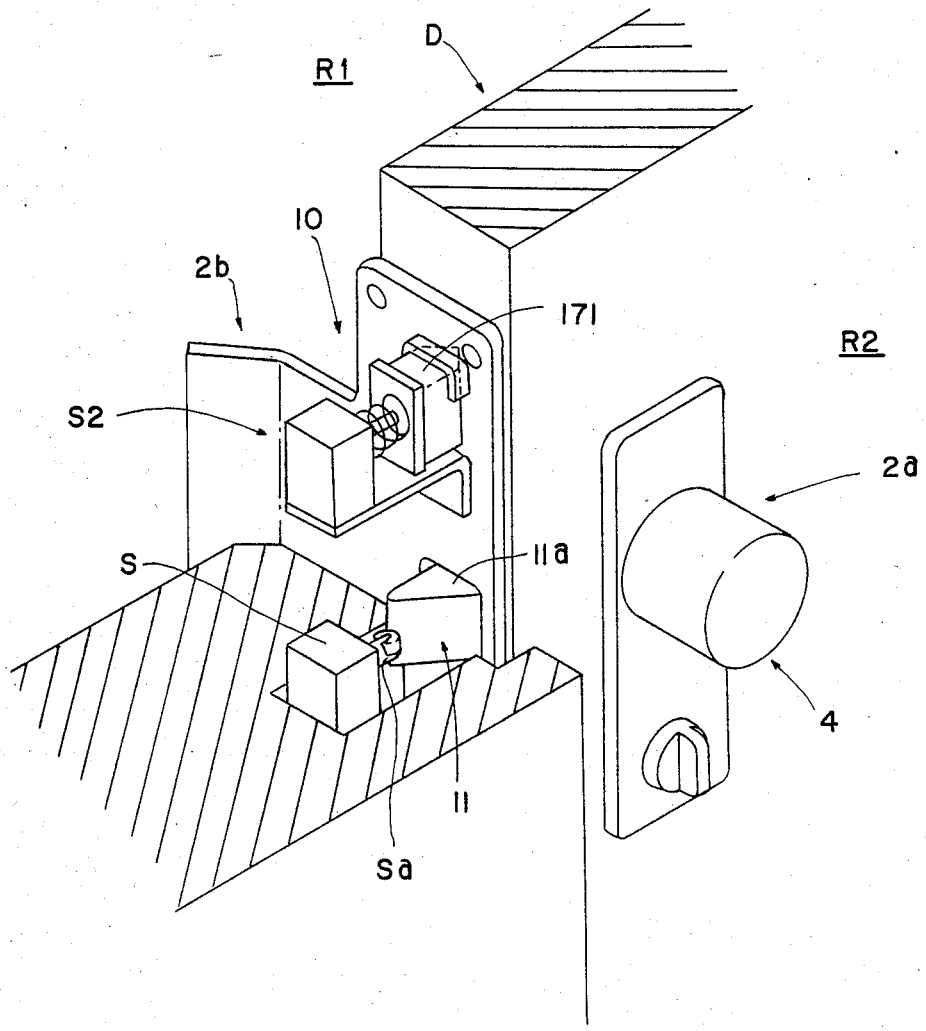
FIG. 56 is a perspective view showing still another example of the present invention.
Figure 57A:
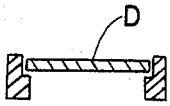
FIGS. 57(*a*) to (*j*) are diagrams showing the working thereof.
Figure 57C:
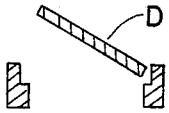
Figure 57E:
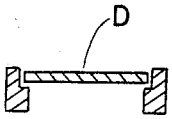
Figure 57B:
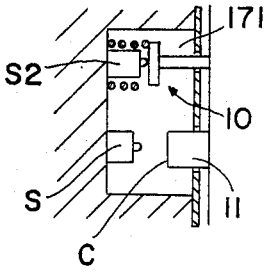
Figure 57D:
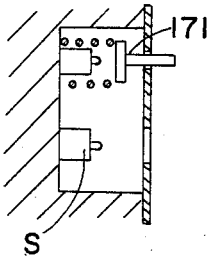
Figure 57F:
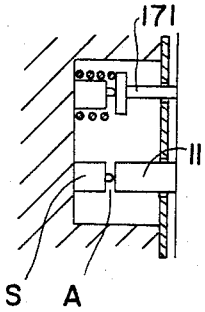
Figure 57G:
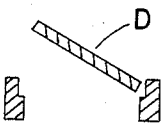
Figure 57I:
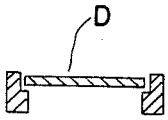
Figure 57H:
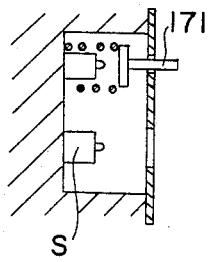
Figure 57J:
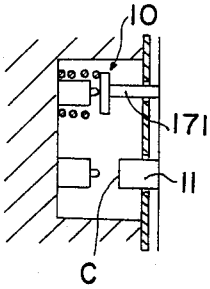
Figure 60:
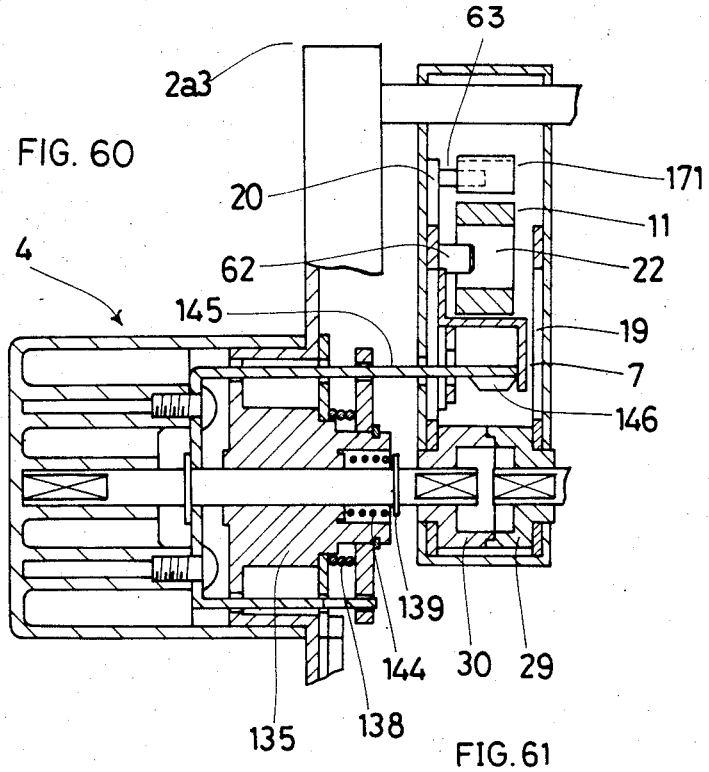
FIG. 60 is a sectional view showing only the principal part of a locking device being used in the example in FIG. 59.
Figure 61:
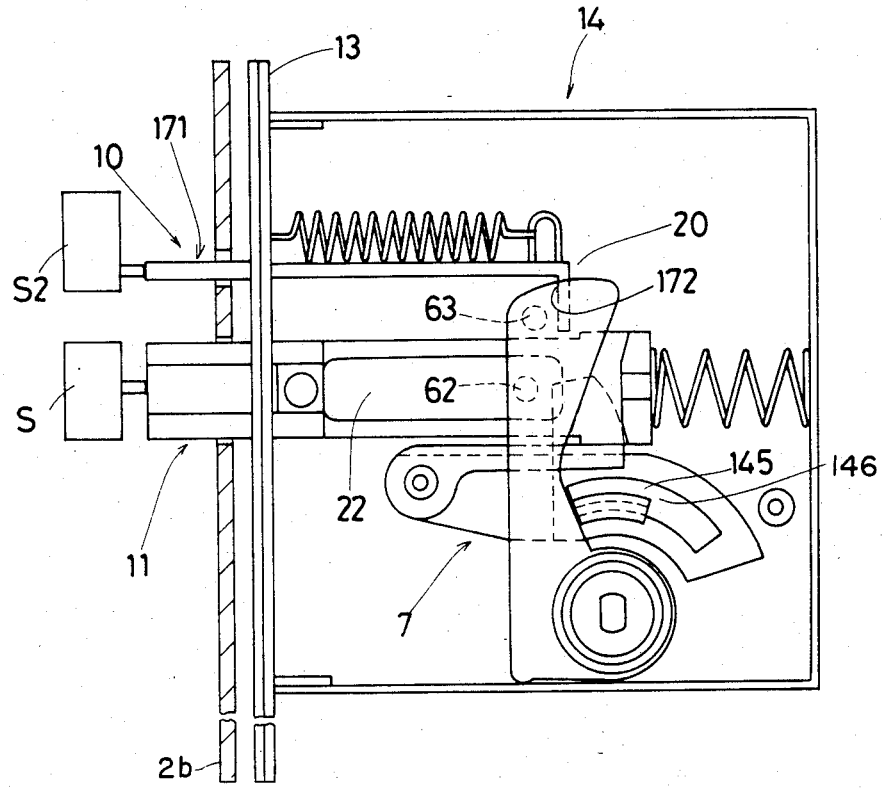
FIG. 61 is a front view of the body of lock being shown while taking away are side wall thereof.
Figure 63:
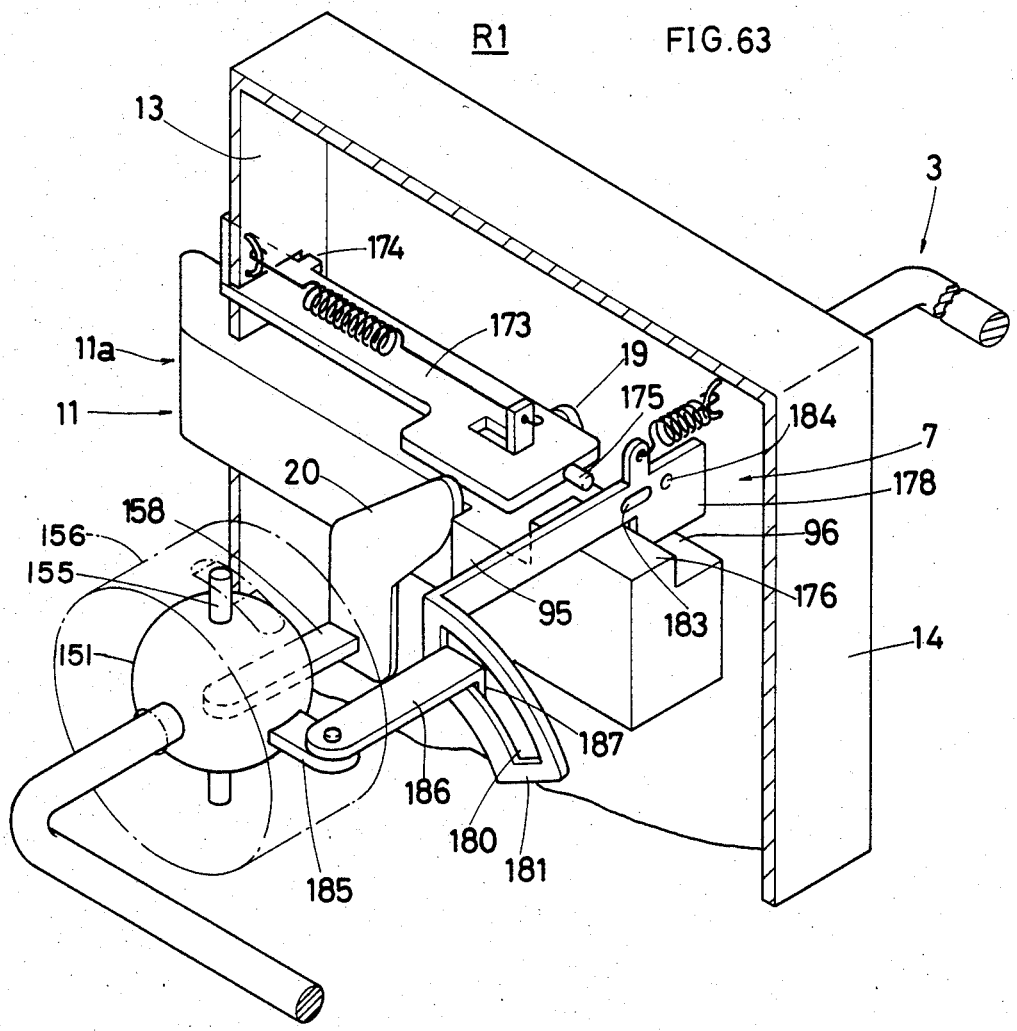
FIG. 63 is a perspective view in rough showing the principal part of another type of the body of lock being used in the door installation according to the invention.

FIGS. 56 to 58 show still a further example of the invention being applied to a opening-out door wherein the door D opens toward the space $R_1$, for example, such as a corridor and the like.

The body of the lock *2a* being used in this example is the same in construction as shown in FIGS. 47 to 54, with the exception of the facts that the releasing means 9 is provided on the second operating unit 4, that the protruding piece 62 is provided on the second lever 20, and that the cut-away surface of the head part *11a* of the lock lever 11 is formed on the side of the space $R_2$. By doing somewhat a little modification, the lock lever 11 can be held in the half-projecting position by handling the first operating unit 3; the lock lever 11 can be made to project to the wholly projecting position A by the rotational or pulling operation of the second operating unit 4; and further as shown in FIG. 56, there is provided on the receiving plate *2b* a detecting means 10 for detecting the shutting of the door D. This detecting means 10 consists of a contact piece 171 being energized by a spring and projecting usually outward over the receiving plate *2b*, and a controlling means S2 detecting the retreat of the contact piece 171 by impinging against the door D. Further, in this example, the controlling means S is of a normally opened type or the controlling means S2 is of a normally closed type, and both are prallel-connected to the electric circuit EC.

Description will be now directed to the working of the above-mentioned detecting means 10, the controlling means S, and the controlling means S2:

In the door shutting state of the space $R_2$ where no one stays, the lock lever 11 is held in the half-projecting position C, and the controlling means S is in the OFF condition, as shown in FIG. 57(*a*), (*b*). Because of the door D having been shut, the contacting piece 171 is projected, and the controlling means S2 is pushed and OFF. Therefore, both the controlling means S and S2 are in the OFF condition, and the electric circuit ES also is OFF.

Now, the door D is opened in order to enter the space $R_2$. As soon as the door is opened, the contact piece 171 of the detecting means 10 separates from the controlling means S2 and places it in the ON condition, when the electric circuit EC is closed, thereby becoming possible to light up the electric appliances E such as, for example, an electric lamp L and the like (shown in FIGS. 57(*c*) and (*d*)).

Then, after getting in the space $R_2$, when the door is shut by gripping the second operating unit 4 attached to the inner side of the door and pulling it, the contact piece 171 impinges upon the controlling means S2, thereby putting the controlling means S2 in the OFF condition. As described in the before-mentioned example, by the pulling motion of the second operating unit 4, the releasing means 9 provided on the second operating unit 4 sets the lock lever 11 in the half-projecting position C free, so that, at the time of door shutting, the lock lever 11 extects up to the wholly projecting position A and presses the controlling means S, thereby closing the electric circuit EC (shown in FIG. 57(*e*) and (*f*).

Now, in retiring from the space $R_2$, the bolt 11 is not engaged in the half-projecting position C by handling the second operating unit 4 to open the door, but projects up to the wholly projecting position A. In this case, the contact piece 171 of the detecting means 10 separates off at the same time the door is opened, and the electric circuit EC operates ON (shown in FIG. 57(*g*), (*h*)).

After retiring to the space $R_1$, when the door D is pushed to be shut, then the lock lever 11 which has been held in the wholly projecting position A is guided by the receiving plate 2*b* and goes back to the door-opeing position B, and after that it projects into the engaging hole 17 of the receiving plate 2*b*. At the time of this projecting motion, the engaging means 7 engages the engaging part 25 of the lock lever 11, as shown in FIGS. 53 and 54. Therefore, the bolt 11 is held in the half-projecting position C to set the controlling means S OFF. On the other hand, concurrently with the door-shutting, the contact piece 171 of the detecting means 10 presses the controlling means S2 to off, when the electric circuit EC is opened to light out.

Like this, also in the case of the opening-out-door D, the lighting on-and off becomes practically by the use of almost the same one as the lock body 2*a* shown in FIGS. 47 to 54, only adding the detecting means 10.

FIGS. 59 to 63 show another example of the case of the door D of the invention being used in the form of an opening-out door.

The present example is different from one which is shown in FIGS. 56 to 58 in two points that the detecting means 10 is equipped with a contact piece 171 that is mounted on the body of lock 2*a*, and that it is so designed as to make the contact piece 171 go backward at the time of handling the second operating unit 20 on the side of the space $R_2$.

The contact piece 171 is a latch bolt-shapedly flat body, which is triangular at its head part, which has an engaging part 172 at its rear through the provision of a suspending piece at its underside, which project always from the front 13 by being energized by a spring, and which goes back or projects with freedom when impinging on the striking piece 2*b*. On the other hand, the second lever 20 is provided at its upper end part with a pin shaped push piece 63. This push piece 63 engages with the engaging part 172 to be able to make the contact piece 171 retreat.

Description will be now directed to the working of the opening-out door in this example:

In the door-shutting state where no one stays in the space $R_2$, the bolt 11 is held in a state of the half-projecting position C, and the controlling means S is put in OFF the condition, as shown in FIGS. 62(*a*) and (*b*). On the other hand, the contact piece 171 of the detecting means 10 projects automatically by shutting the door D and thereby presses the controlling means S2 to put it in the OFF condition. In consequence, the electric circuit EC is in the off condition in company with the controlling means S and S2 being OFF.

Now, the door D is opened in order to enter the space $R_2$. Concurrently with opening the door D, the contact piece 171 of the detecting means 10 separates from the controlling means S2, whereby the controlling means S operates ON and the electric EC is closed, being able to light the electric appliances E, for example, such as an electric lamp L and the like (shown in FIGS. 62(*c*) and (*d*)).

Directly after stepping in the space $R_2$, when the door is shut by gripping and pulling the second operating unit 4, then the contact piece 171 impinges against the controlling means S2, thereby setting that controlling means S2 OFF. As described in the before-mentioned example, by the pulling motion of the second operating unit 4, the releasing means 9 being provided on the second operating unit 4 releases the lock lever 11 in the half projecting position C. Consequently, at the time of shutting the door, the lock lever 11 extends up to the wholly projecting position A to press the controlling means S, thereby closing the electric circuit EC (shown in FIGS. 62(*e*) and (*f*)).

On the contrary, at the time of retiring the room, the bolt 11 is not engaged in the half projecting position C by the handling the second operating unit 4 in order to open the door D, but projects to the wholly projecting position A. On the other hand, the engaging part 172 of the contact piece 171 of the detecting means 10 retreats by being pushed by the push piece 63, thereby putting the electric circuit EC in the ON condition (shown in FIGS. 62(*g*) and (*h*)).

Accordingly, as seen from the example in FIGS. 56 to 58, it becomes possible to prevent the electric circuit EC from being put in the OFF condition which takes place concurrently with the then handling of the second operating unit 4.

After retiring to the space $R_1$, the door D is pushed and shut. The bolt 11, which is held in the wholly projecting position A, is guided by the receiving plate 2*b*, and, after going back up the door-opening position B, projects into the engaging hole 17 of the receiving plate 2*b*. At the time of this projection of the bolt 11, the engaging means 7 engages the engaging part 25 of the as shown in FIGS. 53, 54. In consequence, the bolt 11 is held in the half-projecting position C and puts the controlling means S in the OFF condition, while, at the same time of shutting the door, the contact piece 171 of the detecting means 10 presses the controlling means S2 to make it be OFF, thereby opening the electric circuit EC to light out.

FIGS. 63 to 67 show an even further example of this invention used in the opening-out door which opens from the space $R_2$ such as a toilet and the like toward the space $R_1$ such as a corridor and the like:

In the case 14, the bolt 11 and the sliding piece 173 are provided, and the engaging means 7 is received. The bolt 11 is formed at its head part 11*a* in the form of a latch bolt which is cut away slantingly on the side of the space $R_2$, that is, on the side of the second operating unit 4, and also it is provided at both the rear parts with protruding parts 95, 96. These protruding parts 95, 96 are pressed as the first and second levers being arranged on both the sides of the bolt 11 swing. The bolt 11 goes back and forth between the wholly projecting position A and the door-opening position B. Further, the bolt 11 is provided at the upper face of its rear part with a protrusion 176 of a half breadth of the bolt 11.

The above-mentioned sliding piece 173 is engaged to the side of the front 13 by a spring. The sliding piece 173 is formed at its head part with an triangular part which is cut down at the same angle as the head part 11*a* of the bolt 11. By the way, the head part of the sliding piece 17 is formed more narrow than the bolt 11, and the side face on the side of the vertex of the triangular part is so arranged as to be made to fall nearly in line with the side of the bolt 11. Accordingly, the projecting length of the sliding piece 173 from the front 13 is smaller than the projecting length of the bolt 11, as shown in FIG. 65. The sliding piece 173 is provided near its front end with a striking piece 174, while an engaging pin 175 projects from its rear end.

The above mentioned engaging means 7 is energized to the side of the first lever 19 by a spring. This engaging means is provided at its one side with a suspending piece 178 hanging down along the inner side of a protruding part 176, and at another side, that is, to the side of the second operating unit 4 is formed with an extending piece 181 having a circular arc groove 180 concentric with the center of rotation of the second operating unit 4.

The engaging means 7 is provided with through-hole 183, 184 whereinto the engaging pin 175 of the sliding piece 173 can insert. The sphere 151 whereto the second operating unit 4 is connected is provided with the side piece 185. The other end of the connecting piece 186, one end of which is supported by the side piece 185, is inserted into the circular arc groove 180. The connecting piece 186 is provided with an engaging piece 187 which is bended downward in the interior of the circular arc groove 180. Therefore, by pulling the second operating unit 4, the engaging means 7 is pulled to the side of the second operating unit 4 through the medium of the side piece 185 and the connecting piece 186.

The supporting shaft 158 being erected in the center of rotation of the second lever 20 is inserted a split groove being provided horizontal to the sphere 151, and is pivoted rotatably by a pin 155 passing through the center of the sphere 151. Incidentally, the sphere 151 is supported by the use of the exterior case 156 same as shown in FIG. 55(*b*).

In the case when no on stays in the space $R_2$ and the door D is shut, the bolt 11 advances into the engaging hole 17 of the receiving plate 2*b*, presses the controlling means S, and turns the electric circuit EC to the OFF position. The sliding piece 173 contacts at its head part with the outside of the receiving plate 2*b*, at the time its engaging pin 175 fits in a through-hole 183. The through-hole 183 may be also formed by the notched part cutting away the engaging means 7.

In entering the room from the space $R_1$ to the space $R_2$, the door is opened by using the first operating unit 3. After the door is opened, when the first operating unit 3 is unhanded, the bolt 11 projects up to the wholly projecting position A. At the same time, the sliding piece 173 also projects, while its engaging pin 175 separates from the through-hole 182 (shown in FIG. 65).

After having gone in the room, the second operating unit 4 is pulled to shut the door. As mentioned above, through the pulling motion of the second operating unit 4 is energized the engaging means 7 in the same direction. Just before the door-opening, the head part 11*a* of the bolt 11 impinges against the receiving plate 2*b* and goes back nearly to the vicinity of the door-opening position B, as shwon in FIG. 66. As a result, the protruding part 176 at the rear of the bolt 11 finishes passing over the engaging means 7, and thereby the engaging means 7 shifts together with the suspending piece 178 to the side of the second operating unit 4. On the other hand, the sliding piece 173 being smaller in projecting length also goes back later than the bolt 11 and its engaging pin 175 fits in the through-hole 184, thereby checking the return of the engaging means 7.

Figure 67:
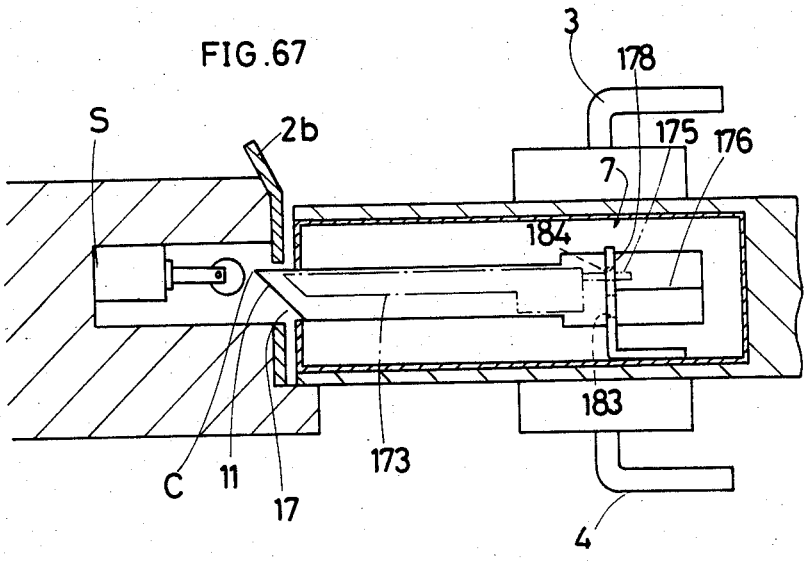

Therefore, when the bolt 11 penetrates into the engaging hole 17 of the receiving plate 2*b*, the protruding part 176 is held in the half-projecting position C by the suspending piece 178 of the engaging means 7 shifted, as shown in FIG. 67. As a result, the controlling means S is not pressed to continue to operate the electric circuit EC ON. In this state, if the second operating unit 4 is made to work repeatedly, the state of the half-projecting position C is maintained as it is. What is more, if the second operating unit 4 is made to rotate in the vertical surface and also the second lever 20 is inclined, the half-projecting position C is held likewise.

At the time of retiring to the space $R_1$, the second operating unit 4 is made to rotate to open to door, when the engaging means 7 returns to the original state by making the sliding piece 173 project and by the engaging pin being pulled out from the through-hole 184, and consequently the bolt 11 is able to project up to the wholly projecting position A.

After retiring from the room, when the door D is shut, the bolt 11 projects up to the wholly projecting position A, returns to the state as shown in FIG. 64, and makes the controlling means work to light out.

In this way, also in the opening-out door, the electric circuit EC is made to smoothly operate ON or OFF by the natural motion accompanied with the opening and shutting of the door D. The lock adopted in this invention can be operated in the same way of using as conventional locks because of its lock lever being made in the form of a latch bolt.

Figure 68:
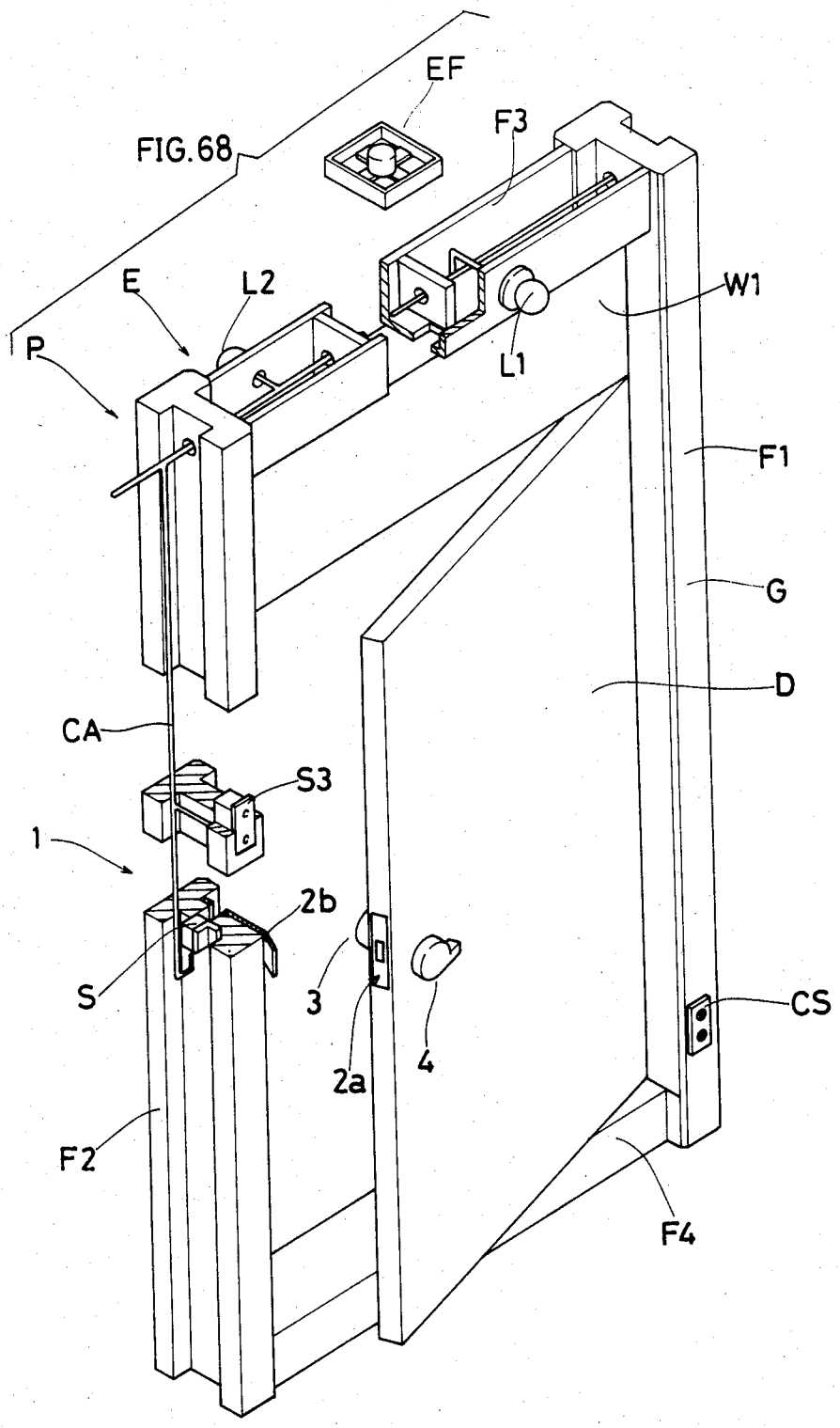
FIG. 68 is an exploded view in perspective of the example of the door installation according to the invention which is to be incorporated in the form of a door panel separately fabricated, for example, in the factory.

FIG. 68 shows an example wherein the door installation 1 of the present invention is formed beforehand as a ready-to-fit door panel P. This door panel P has the ability to constitute a part of the wall body of the house by being incorporated into the building construction work. The door panel P consists of a door D and a frame body G surrounding the door D. The frame body is provided with a vertical frame member F1 to which the door D is to be attached and a vertical frame member F2 toward which the open end of the door D is to be fronted. To the top and bottom of the vertical frame members F1, F2 are attahced an upper frame members F3 and a lower frame member F4, respectively, while on the underside of the upper frame member F3 is provided a hanging wall W1. On the door D is installed the body of lock 2*a* which has a first operating unit 3 and a second operating unit 4 while in the vertical frame member F2 are fitted a receiving plate 2*b*, a controlling means S, and a main switch S3. Over the upper frame member F3 are mounted lighting means L1, L2, and an electric fan EF. Further, on the lower part of the vertical frame member F1 is equipped a plug receptacle CS. All of those such as above-mentioned are wired beforehand by the use of a code. These operations are conducted in the factory.

The employment of such a type of door panel P makes permits a reduction in the operations on the spot of construction work, to enhance the efficiency of execution, and to make the quality uniform. In this connection, it is good if the wiring of a cord or the installation of part of electric appliances E and such like would be done so as to be able to perform on the working field.

In such a way, the door installation according to the present invention employs a locking device provided with such a kind of lock lever as being held in the half-projecting position between the wholly projecting position and the door-opening position. Concurrently with the opening and shutting of the door, the bolt 11 operates the controlling means ON or OFF and when entering or retiring from the room, it can make the electric appliances automatically operate ON or OFF and simplifies the switching operation.

Being not restricted within the above-mentioned, the door installation according to the present invention has such abilities as to eliminate the incompleteness of the motion of the controlling means by the provision of the check piece to make the door securely shut, as to be used even in the room where a plurality of persons go in and out frequently by the provision of the power supply-maintaining means, and further as to be able to perform the operation nearly not different from the opening and shutting operation of conventional doors by the employment of the releasing means, thereby being able to enhance the operability sharply.

Incidentally, in the door installation according to the present invention, it is possible to also use the lead switch, inclusive of the micro-switch, as the controlling means, and further to adopt, in the capacity of the body of the lock, any kind of one, if it only has such a lock lever as being engaged in the half-projecting position, other than shown in the examples. As for the half-projecting position, it is possible to be installed in the plural number and any positions between the wholly projecting position A and door-opening position B.

What is more, the controlling means can be incorporated in the interior of the door other than in the frame member. The bolt may be formed so as to be able to rotate as the hanging lock, other than the one movable to and fro such as shown in the previously-mentioned examples. In those cases, by preparing the bolt at its head with a hook part, it is usable not only in hinged doors, but also in sliding doors, folding door, or rotating door and others, and that it is can be adopted for single-swing doors, resultant pair swing doors, etc., etc.

Although the invention has been described in its preferred form with a certain degree of particularity, it is understood that the present disclosure of the preferred form has been changed in the details of construction and the combination and arrangement of parts may resorted to without departing from the spirit and the scope of the invention as hereinafter claimed.

What we claim is:

1. A door installation comprising;

a door being provided with a body of a lock and operating units one by one on either side thereof;

a frame member facing to said door and being equipped with a receiving plate;

a controlling means being operatively connected to the frame;

a bolt operatively positioned within said lock and being energized by a spring toward a wholly projecting position, said operating units being operatively connected to said bolt for selectively imparting motion thereto and for releasing said bolt;

said bolt being movable from the wholly projecting position to a door-opening position against the spring by operation of one of said operating units;

said bolt being slidable from a door-opening position to the wholly projecting position by releasing the one operating unit and by being energized by said spring;

said bolt being movable from the wholly projecting position to the door-opening position against the spring by operation of the other operating unit;

said body of said lock being provided with an engaging means which can hold said bolt at a half-projecting position between the door-opening position and the wholly projecting position;

said bolt being held at the half-projecting position on a returning motion of said bolt from said door-opening position accomplished by said operation of the other operating unit, said bolt being returnable by releasing the other operating unit and by being energized by said spring;

said receiving plate being formed with an engaging hole into which said bolt is insertable at the wholly projecting position and half-projecting position thereof;

said controlling means being received within said receiving plate for sensing the position of said bolt in order to distinguish said bolt which is not inserted in the engaging hole and which is in the half-projecting position, from the bolt which is in the wholly projecting position for enabling said controlling means to turn on, off or maintain an electrical connection to a power source.

2. A door installation as set forth in claim 1, wherein said receiving plate is provided at its impinging side against said bolt with a buffering member.

3. A door installation as set forth in claim 1, wherein said bolt is provided with a buffering member.

4. A door installation as set forth in claim 1, wherein said bolt is in the shape of a latch bolt having a head part which is extruded from the body of the lock at the half-projecting position, which is slantingly cut away at the side facing the closing side of the door.

5. A door installation as set forth in claim 1, wherein said bolt is provided with a part being formed at both sides in a parallel manner, and further this part forms a check piece checking the door from being shut after opening the door.

6. A door installation as set forth in claim 1, said engaging means is an arm energized toward said bolt and the bolt is provided with an engaging part, while said bolt is made to be held in the half-projecting position through the engagement of said engaging part with said engaging means.

7. A door installation as set forth in claim 1, said one operating unit is connected with a lever equipped with a protruding piece which can release the engagement of said engaging part with said engaging means.

8. A locking device comprising:

a body of a lock;

a receiving plate;

operating units connected one on either side of said lock;

a bolt being operatively positioned within said lock and being energized by a spring toward a wholly projecting position said operating units being operatively connected to said bolt for selectively imparting motion thereto and for releasing said bolt;

said bolt being movable from the wholly projecting position to a door-opening position against the spring by operation of one of said operating units;

said bolt being slidable from the door-opening position to the wholly projecting position by releasing said one operating unit and by being energized by said spring;

said bolt being movable from the wholly projecting position to the door-opening position against the spring by operation of the other operating unit;

said body of said lock being provided with an engaging means which can hold said bolt at a half-projecting position between the door-opening position and the wholly projecting position;

said bolt being held at the half-projecting position on a returning motion of said bolt from said door-opening position accomplished by said operation of the other operating unit, said bolt being returnable by releasing the other operating unit and by being energized by said spring;

said receiving plate being formed with an engaging hole into which said bolt is insertable at the wholly projecting position and half-projecting position thereof for enabling said bolt to turn on, off or maintain an electrical connection to a power source.

9. A locking device as set forth in claim 8, wherein said bolt is in the shape of a latch bolt having a head part, which is extruded from the body of the lock at the half-projecting position, which is slantingly cut away at the side facing the closing side of the door.

10. A licking device as set forth in claim 8, wherein said bolt is provided with the part being formed at its both sides parallel, and further this part forms a check piece checking the door from being shut after opening the door.

11. A door installation as set forth in claim 8, wherein said receiving plate is provided at its impinging side against said bolt with a buffering member.

12. A door installation as set forth in claim 8, wherein said bolt is provided with a buffering member.

13. A locking device as set forth in claim 8, said engaging means is an arm energized toward said bolt and the bolt is provided with an engaging part, while said bolt is made to be held in the half-projecting position through the engagement of said engaging part with said engaging means.

14. A locking device as set forth in claim 8, said one operating unit is connected with a lever equipped with a protruding piece which can release the engagement of said engaging part with said engaging means.

* * * * *